US010589535B2

(12) United States Patent
Saeki et al.

(10) Patent No.: US 10,589,535 B2
(45) Date of Patent: Mar. 17, 2020

(54) INKJET RECORDING APPARATUS AND METHOD OF CONTROLLING THE SAME

(71) Applicant: CANON KABUSHIKI KAISHA, Tokyo (JP)

(72) Inventors: Tsuyoshi Saeki, Kawasaki (JP); Toshiaki Tokisawa, Kawasaki (JP); Kyoshiro Okude, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/019,137

(22) Filed: Jun. 26, 2018

(65) Prior Publication Data

US 2019/0009566 A1 Jan. 10, 2019

(30) Foreign Application Priority Data

Jul. 7, 2017 (JP) ..... 2017-133836

(51) Int. Cl.
*B41J 2/175* (2006.01)
*B41J 2/18* (2006.01)
*B41J 29/02* (2006.01)

(52) U.S. Cl.
CPC ..... *B41J 2/18* (2013.01); *B41J 2/17596* (2013.01); *B41J 29/02* (2013.01)

(58) Field of Classification Search
USPC ..... 347/85, 17
See application file for complete search history.

(56) References Cited

U.S. PATENT DOCUMENTS 7,980,683 B2 * 7/2011 Bansyo ..... B41J 2/175 347/17
8,974,046 B2 * 3/2015 Ooishi ..... B41J 2/175 347/7
2009/0195588 A1 * 8/2009 Ogama ..... B41J 2/04508 347/17
2010/0079562 A1 * 4/2010 Katada ..... B41J 2/175 347/85
2012/0188314 A1 * 7/2012 Akiyama ..... B41J 2/175 347/85
2014/0300670 A1 * 10/2014 Tsukamoto ..... B41J 2/175 347/85

FOREIGN PATENT DOCUMENTS

JP 2014-144611 A 8/2014

* cited by examiner

*Primary Examiner* — Lam S Nguyen
(74) *Attorney, Agent, or Firm* — Canon U.S.A., Inc. IP Division

(57) ABSTRACT

An inkjet recording apparatus that the throughput until a start of a recording operation in the structure in which an ink is circulated between a recording head and an ink tank includes the recording head which discharges the ink to perform a recording operation, the ink tank which stores the ink, and a buffer chamber having a volume which is changed according to a pressure. When the inkjet recording apparatus is changed from a circulation state in which a supply pump and a collection pump are driven to circulate the ink between the recording head and the ink tank to a pause state in which the driving of the supply pump and the collection pump is stopped to stop the circulation of the ink, a negative pressure due to a change in the volume of the buffer chamber is maintained.

14 Claims, 16 Drawing Sheets

S
12
13
7
18
11
7b
8
P
19
7a
x
y
z

INKJET RECORDING APPARATUS AND METHOD OF CONTROLLING THE SAME

BACKGROUND OF THE INVENTION

Field of the Invention

The disclosure relates to an inkjet recording apparatus configured to record images using a recording head.

Description of the Related Art

Japanese Patent Application Laid-Open No. 2014-144611 discusses an inkjet recording apparatus including an inkjet head which discharges ink and an ink tank which stores ink to be supplied to the inkjet head. The ink tank and the inkjet head are connected to each other by a supply channel and a collection channel to circulate the ink between the ink tank and the inkjet head. Further, the ink flows also in the vicinity of a nozzle of the recording head due to a difference in pressure between the first and second channels to prevent the ink in the vicinity of the nozzle from thickening so that stable discharge performance is maintained.

However, the apparatus discussed in Japanese Patent Application Laid-Open No. 2014-144611 performs operations of opening and closing a supply valve provided in the first channel and a collection valve provided in the second channel to circulate the ink and also performs driving adjustment, so that it takes time to start the next recording operation in some cases.

SUMMARY OF THE INVENTION

The disclosure is directed to an inkjet recording apparatus capable of improving throughput up to a start of a recording operation in a structure of circulating ink between a recording head and an ink tank.

According to an aspect of the disclosure, an inkjet recording apparatus includes a recording head which discharges an ink to perform a recording operation, an ink tank which stores the ink to be supplied to the recording head, a supply channel through which the ink is supplied from the ink tank to the recording head, a supply pump provided in the supply channel, a collection channel through which the ink is collected from the recording head to the ink tank, a collection pump provided in the collection channel, and a buffer chamber provided in the recording head or the collection channel and having a volume which is changed according to a pressure. The recording head includes a discharge opening through which the ink is discharged, a common channel connected with the supply channel and the collection channel, and a pressure control unit which changes, according to the pressure, between an opened state in which the ink is passed through the common channel and a closed state in which the ink is not passed through the common channel. The inkjet recording apparatus forms a circulation state in which the ink is circulated between the recording head and the ink tank by driving the supply pump and the collection pump in a case where the recording operation is performed, whereas the inkjet recording apparatus stops the driving of the supply pump and the collection pump and forms a pause state in which the ink is not circulated in a case the recording operation is not performed. When the inkjet recording apparatus is to be changed from the circulation state to the pause state, the inkjet recording apparatus stops the driving of the supply pump and the collection pump and forms a waiting state in which the pressure in the collection channel is lowered than that in the pause state by the buffer chamber.

Further features and aspects of the disclosure will become apparent from the following description of numerous example embodiments (with reference to the attached drawings).

DESCRIPTION OF THE EMBODIMENTS

Figure 1:
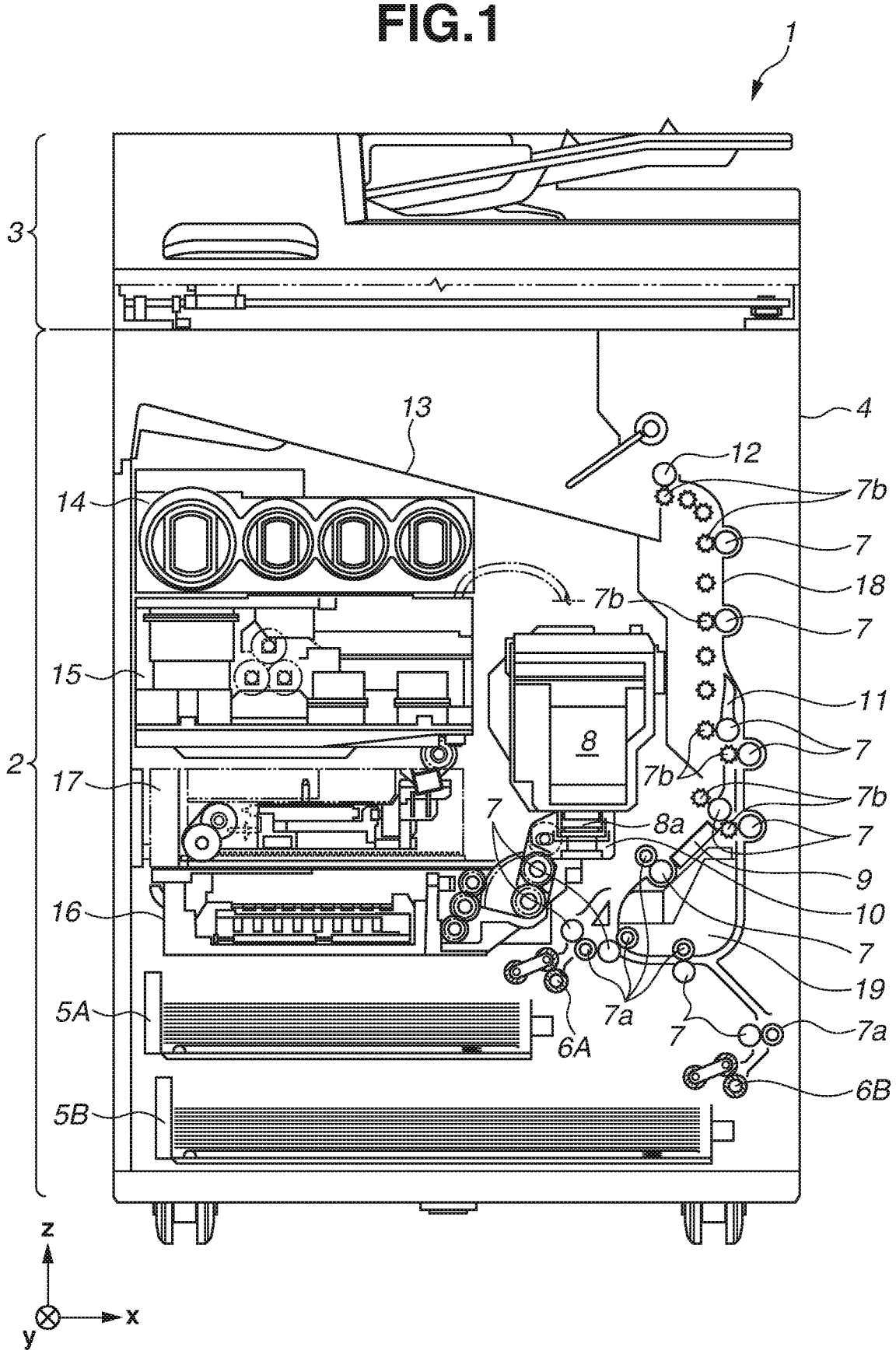
FIG. 1 illustrates an inkjet recording apparatus in a waiting state.

A first example embodiment will be described below. FIG. 1 is an interior structure diagram illustrating an inkjet recording apparatus (hereinafter, "recording apparatus") 1 of the present example embodiment. Hereinafter, x-, y-, and z-directions respectively refer to the horizontal direction, the direction in which discharge openings of a recording head 8 are aligned (perpendicular direction with respect to the sheet surface), and the vertical direction.

The recording apparatus 1 is a multi-function peripheral including a printing portion 2 and a scanner portion 3, and the printing portion 2 and the scanner portion 3 can execute various types of processing relating to recording and reading operations either separately or in conjunction. The scanner portion 3 includes an auto-document feeder (ADF) and a flatbed scanner (FBS) and is capable of reading documents fed automatically by the ADF and is also capable of reading (scanning) documents placed on a document plate of the FBS by the user. While the present example embodiment describes the multi-function peripheral including both the printing portion 2 and the scanner portion 3, the scanner portion 3 can be omitted. FIG. 1 illustrates the recording apparatus 1 in a waiting state in which neither recording operations nor reading operations are performed.

In the printing portion 2, first and second cassettes 5A and 5B which store recording mediums (cut sheets) S are removably attached to the lower bottom part of a housing 4 in the vertical direction. The first cassette 5A stores relatively small recording mediums up to A4 size which are laid out flat, and the second cassette 5B stores relatively large recording mediums up to A3 size which are also laid out flat. In the vicinity of the first cassette 5A is provided a first sheet feeding unit 6A which separates and feeds the stored recording mediums one by one. Similarly, in the vicinity of the second cassette 5B is provided a second sheet feeding unit 6B. When a recording operation is performed, the recording medium S is selectively fed from one of the first and second cassettes 5A and 5B.

Conveyance rollers 7, a sheet ejection roller 12, pinch rollers 7*a*, spurs 7*b*, a guide 18, an inner guide 19, and a flapper 11 are a conveyance mechanism for guiding the recording medium S in a predetermined direction. The conveyance rollers 7 are driving rollers which are disposed on the upstream and downstream sides of the recording head 8 and are driven by a conveyance motor (not illustrated). The pinch rollers 7*a* are driven rollers which are disposed on the upstream side of the recording head 8 and nip and rotate the recording medium S together with the conveyance rollers 7. The sheet ejection roller 12 is a driving roller which is disposed at the most downstream part of the conveyance route and is driven by the conveyance motor (not illustrated). The spurs 7*b* are disposed on the downstream side of the recording head 8 and guide the recording medium S in a predetermined direction. The spurs 7*b* that are disposed to face the conveyance rollers 7 or the sheet ejection roller 12 sandwich and convey the recording medium S together with the conveyance rollers 7 or the sheet ejection roller 12.

The guide 18 is provided in the conveyance route for the recording medium S and guides the recording medium S in the predetermined direction. The inner guide 19 is a member which extends in the y-direction and includes a curved side surface. The inner guide 19 guides the recording medium S along the side surface. The flapper 11 is a member for changing the conveyance direction of the recording medium S in two-sided recording operations. A sheet ejection tray 13 is a tray for stacking and holding the recording medium S that undergoes a recording operation has been performed on, and has been ejected by the sheet ejection roller 12.

The recording head 8 of the present example embodiment is a full-line type color inkjet recording head, and the plurality of discharge openings from which ink is discharged based on recording data is aligned in width corresponding to the width of the recording medium S in the y-direction in FIG. 1. When the recording head 8 is in a standby position as illustrated in FIG. 1, a discharge opening surface 8*a* of the recording head 8 is capped with a cap unit 10. The position of the cap unit 10 is also referred to as "capping position". When the recording head 8 performs a recording operation, the orientation of the recording head 8 is changed by a print controller 202 described below such that the discharge opening surface 8*a* faces a platen 9. The platen 9 includes a flat plate extending in the y-direction and supports from the back surface the recording medium S on which the recording head 8 performs a recording operation. The movement of the recording head 8 from the standby position to a recording position will be described in detail below.

An ink tank unit 14 stores four color inks to be supplied to the recording head 8. A channel connecting the ink tank unit 14 and the recording head 8 to each other is provided with an ink supply unit 15 disposed between the ink tank unit 14 and the recording head 8, and the ink supply unit 15 adjusts the pressure and flow rate of ink in the recording head 8. In the present example embodiment, a circulation-type ink supply system is employed, and the ink supply unit 15 adjusts within suitable ranges the pressure of ink supplied to the recording head 8 and the flow rate of ink collected from the recording head 8.

A maintenance unit 16 includes the cap unit 10 and a wiping unit 17 and causes the cap unit 10 and the wiping unit 17 to operate at predetermined timings to perform a maintenance operation on the recording head 8. Details of the maintenance operation will be described below.

Figure 2:
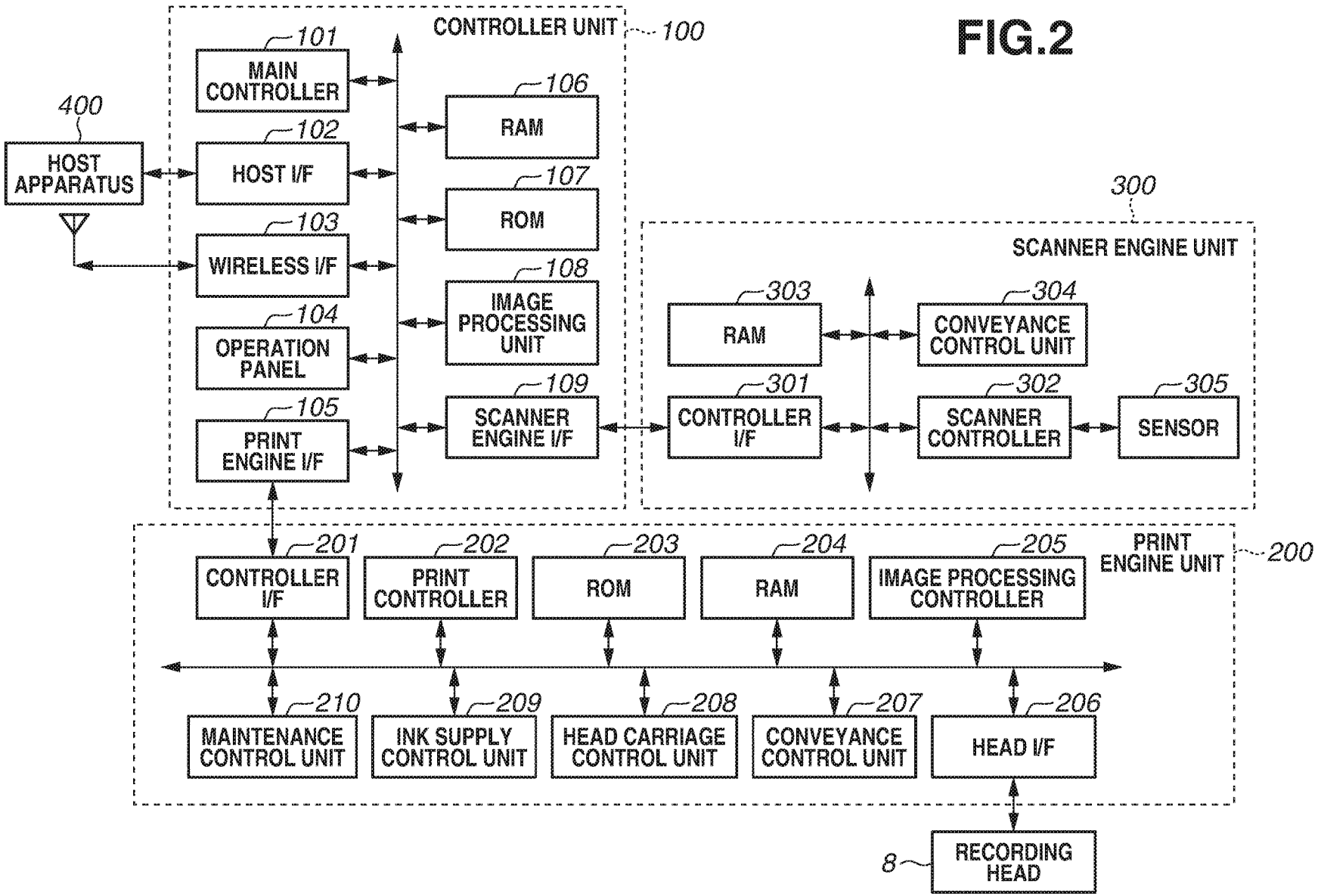
FIG. 2 is a block diagram illustrating a control configuration of the inkjet recording apparatus.

FIG. 2 is a block diagram illustrating a control configuration in the recording apparatus 1. The control configuration mainly includes a print engine unit 200 which comprehensively controls the printing portion 2, a scanner engine unit 300 which comprehensively controls the scanner portion 3, and a controller unit 100 which comprehensively controls the recording apparatus 1. The print controller 202 controls various mechanisms of the print engine unit 200 according to instructions from a main controller 101 of the controller unit 100. Various mechanisms of the scanner engine unit 300 are controlled by the main controller 101 of the controller unit 100. The following describes details of the control configuration.

In the controller unit 100, the main controller 101 including a central processing unit (CPU) comprehensively controls the recording apparatus 1 using a random-access memory (RAM) 106 as a work area based on a program and various parameters stored in a read-only memory (ROM) 107. For example, if a print job is input from a host apparatus 400 via a host interface (I/F) 102 or a wireless I/F 103, an image processing unit 108 performs predetermined image processing on received image data based on instructions from the main controller 101. Then, the main controller 101 transmits, to the print engine unit 200 via a print engine I/F 105, the image data having undergone the image processing.

The recording apparatus 1 can acquire image data from the host apparatus 400 via wireless or wired communication or from an external storage apparatus (e.g., universal serial bus (USB) memory) connected with the recording apparatus 1. Communication methods for use in the wireless or wired communication are not limited. For example, Wi-Fi (Wireless Fidelity) (registered trademark) and Bluetooth (registered trademark) are applicable as a communication method for use in the wireless communication. Further, USB or the like is usable as a communication method for use in the wired communication. Further, for example, if a reading command is input from the host apparatus 400, the main controller 101 transmits the reading command to the scanner portion 3 via a scanner engine I/F 109.

An operation panel 104 is a mechanism for the user to perform inputting and outputting on the recording apparatus 1. The user can give an instruction to perform an operation such as a copy or scan operation, set a printing mode, and recognize information about the recording apparatus 1 via the operation panel 104.

In the print engine unit 200, the print controller 202 including a CPU controls various mechanisms of the printing portion 2 using a RAM 204 as a work area based on a program and various parameters stored in a ROM 203. If various commands and image data are received via a controller I/F 201, the print controller 202 temporarily saves the various commands and image data in the RAM 204. The print controller 202 causes an image processing controller 205 to convert the saved image data into recording data so that the recording head 8 can use the recording data in a recording operation.

If the recording data is generated, the print controller 202 causes the recording head 8 via a head I/F 206 to execute a recording operation based on the recording data. At this time, the print controller 202 drives via a conveyance control unit 207 the first and second sheet feeding units 6A and 6B, the conveyance rollers 7, the sheet ejection roller 12, and the flapper 11 in FIG. 1 to convey a recording medium S. The recording head 8 executes a recording operation in conjunction with the operation of conveying the recording medium S to perform printing processing according to instructions from the print controller 202.

A head carriage control unit 208 changes the orientation and position of the recording head 8 based on the operation state of the recording apparatus 1 such as a maintenance state or recording state. An ink supply control unit 209 controls the ink supply unit 15 to adjust the pressure of ink supplied to the recording head 8 within a suitable range. A maintenance control unit 210 controls the operations of the cap unit 10 and the wiping unit 17 of the maintenance unit 16 when a maintenance operation is performed on the recording head 8.

In the scanner engine unit 300, the main controller 101 controls hardware resources of a scanner controller 302 using the RAM 106 as a work area based on a program and various parameters stored in the ROM 107. In this way, various mechanisms of the scanner portion 3 are controlled. For example, the main controller 101 controls the hardware resources in the scanner controller 302 via a controller I/F 301 to convey a document placed on the ADF by the user via a conveyance control unit 304 and reads the document with a sensor 305. Then, the scanner controller 302 saves the read image data in a RAM 303. The print controller 202 converts the thus acquired image data into recording data so that the recording head 8 can execute a recording operation based on the image data read by the scanner controller 302.

Figure 3:
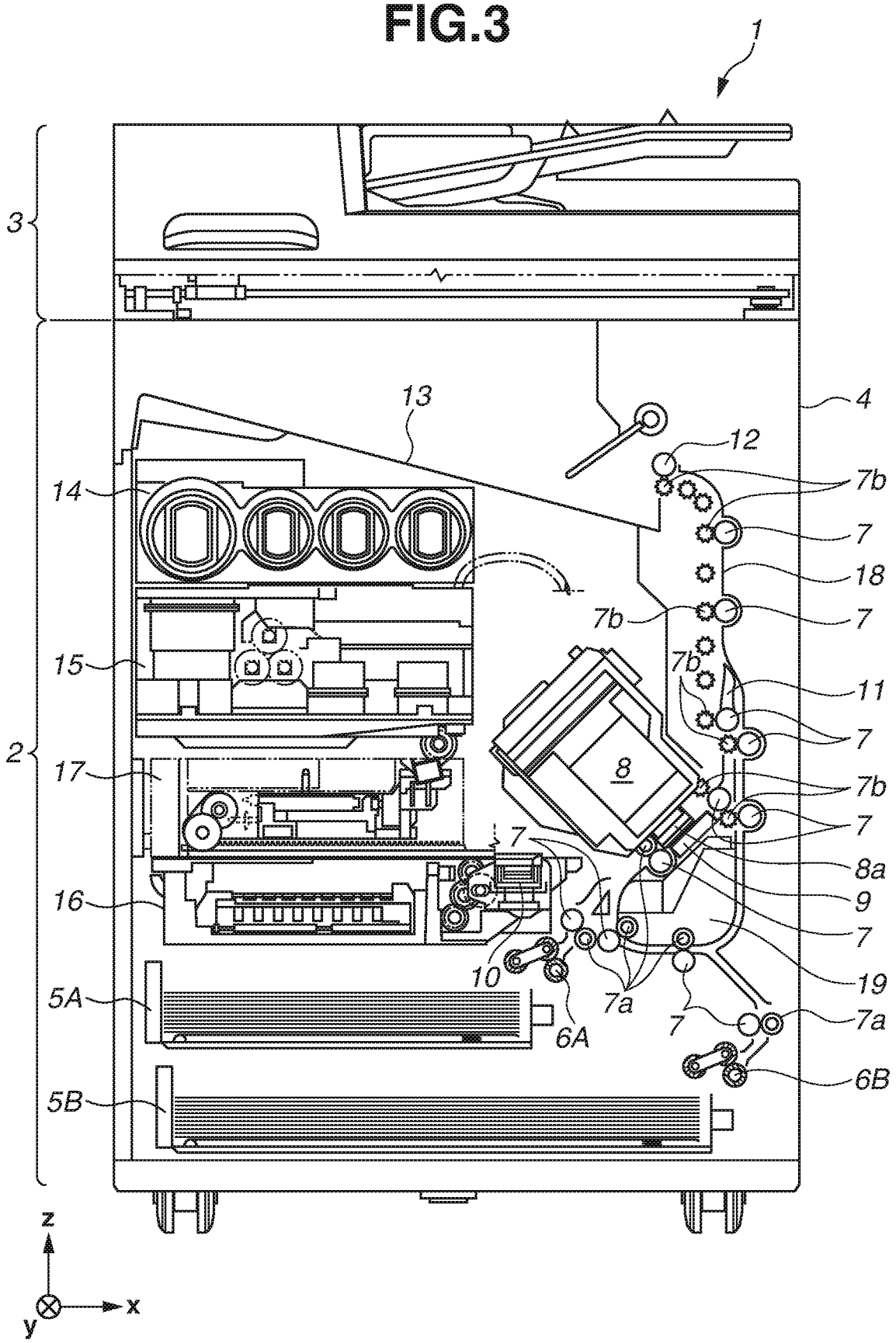
FIG. 3 illustrates the inkjet recording apparatus in a recording state.

FIG. 3 illustrates the recording apparatus 1 in the recording state. Compared to the waiting state illustrated in FIG. 1, the cap unit 10 is separated from the discharge opening surface 8*a* of the recording head 8, and the discharge opening surface 8*a* faces the platen 9. In the present example embodiment, a flat surface of the platen 9 is inclined by about 45 degrees with respect to the horizontal direction, and the discharge opening surface 8*a* of the recording head 8 in the recording position is also inclined by about 45 degrees with respect to the horizontal direction to maintain a predetermined distance from the platen 9.

When the recording head 8 is moved from the standby position illustrated in FIG. 1 to the recording position illustrated in FIG. 3, the print controller 202 moves the cap unit 10 downward to a retracted position illustrated in FIG. 3 using the maintenance control unit 210. In this way, the discharge opening surface 8*a* of the recording head 8 is separated from a cap member 10*a*. Thereafter, the print controller 202 rotates the recording head 8 by 45 degrees while lowering the height of the recording head 8 in the vertical direction using the head carriage control unit 208 so that the discharge opening surface 8*a* faces the platen 9. The foregoing steps are reversely performed by the print controller 202 to move the recording head 8 from the recording position to the standby position after the recording operation is completed.

Next, the conveyance route for the recording mediums S in the printing portion 2 will be described below. If a recording command is input, the print controller 202 first moves the recording head 8 to the recording position illustrated in FIG. 3 using the maintenance control unit 210 and the head carriage control unit 208. Thereafter, the print controller 202 drives one of the first and second sheet feeding units 6A and 6B using the conveyance control unit 207 according to the recording command to feed the recording medium S.

Figure 4C:
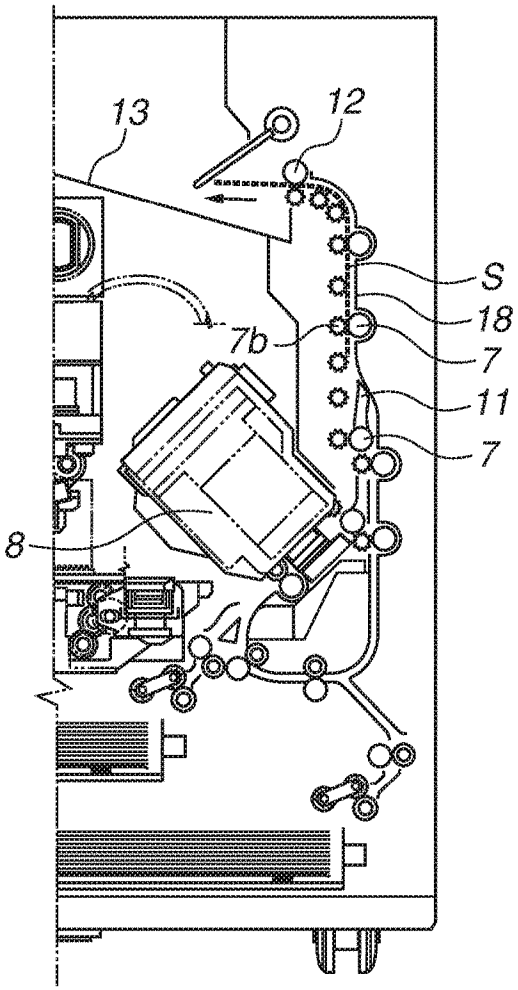
FIGS. 4A to 4C are diagrams each illustrating a conveyance route of a recording medium fed from a first cassette.
Figure 4B:
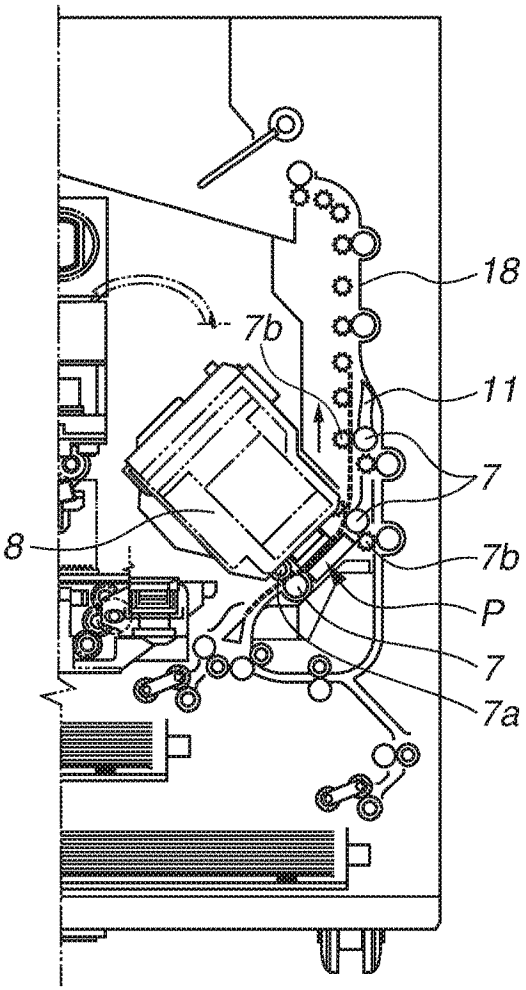
Figure 4A:
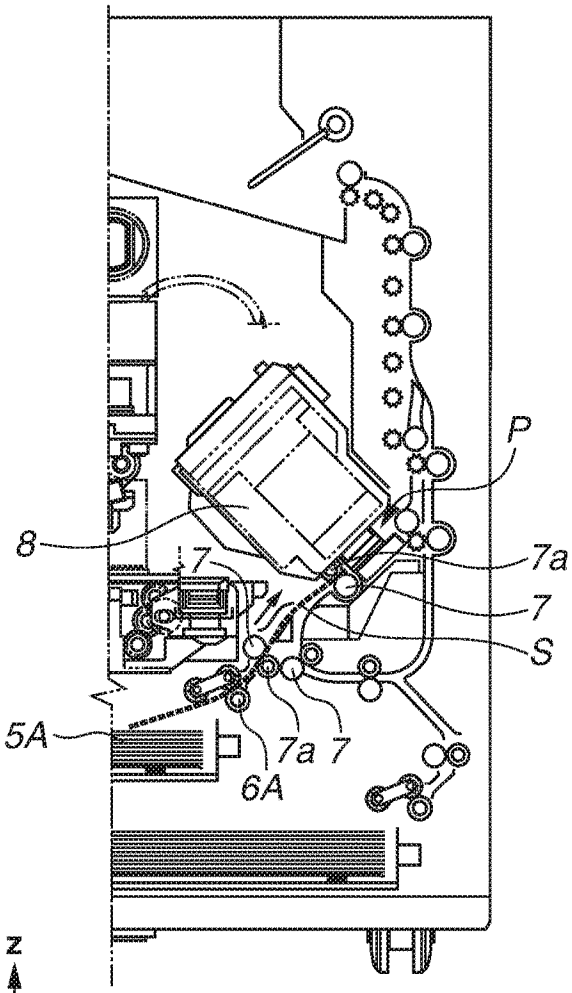
Figure 4A:
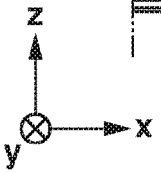

FIGS. 4A to 4C illustrate a conveyance route for feeding the A4-size recording mediums S stored in the first cassette 5A. In FIGS. 4A to 4C and subsequent figures, the recording medium S that is conveyed is specified by a dotted line. The uppermost recording medium S in the first cassette 5A is separated from the second and subsequent recording mediums S by the first sheet feeding unit 6A and is conveyed toward a recording region P between the platen 9 and the recording head 8 while being nipped by the conveyance rollers 7 and the pinch rollers 7*a*. FIG. 4A illustrates a conveyance state immediately before the leading edge of the recording medium S reaches the recording region P. The traveling direction of the recording medium S is changed from the horizontal direction (x-direction) to a direction inclined by about 45 degrees with respect to the horizontal direction after the recording medium S is fed to the first sheet feeding unit 6A and before the recording medium S reaches the recording region P.

At the recording region P, the inks are discharged from the plurality of discharge openings of the recording head 8 toward the recording medium S. The back surface of the recording medium S, in the region to which the inks are to be applied, is supported by the platen 9, and the distance between the discharge opening surface 8*a* and the recording medium S is maintained constant. The recording medium S with the inks applied thereon is guided by the sheet ejection roller 12 and the spurs 7*b* so that the leading edge of the recording medium S is passed through the left side of the flapper 11 inclined rightward as in FIGS. 4A to 4C and is conveyed upward in the vertical direction of the recording apparatus 1 along the guide 18. FIG. 4B illustrates the state in which the leading edge of the recording medium S is passed through the recording region P and is conveyed upward in the vertical direction. The traveling direction of the recording medium S, after the recording medium S is passed through the recording region P inclined by about 45 degrees with respect to the horizontal direction, is changed to the upward direction in the vertical direction by the conveyance rollers 7 and the spurs 7*b*.

After conveyed upward in the vertical direction, the recording medium S is ejected onto the sheet ejection tray 13 by the sheet ejection roller 12 and the spurs 7*b*. FIG. 4C illustrates the state in which the leading edge of the recording medium S is ejected into the sheet ejection tray 13. The recording medium S is ejected such that the surface on which an image is recorded by the recording head 8 faces downward, and the recording medium S is held on the sheet ejection tray 13.

Figure 5C:
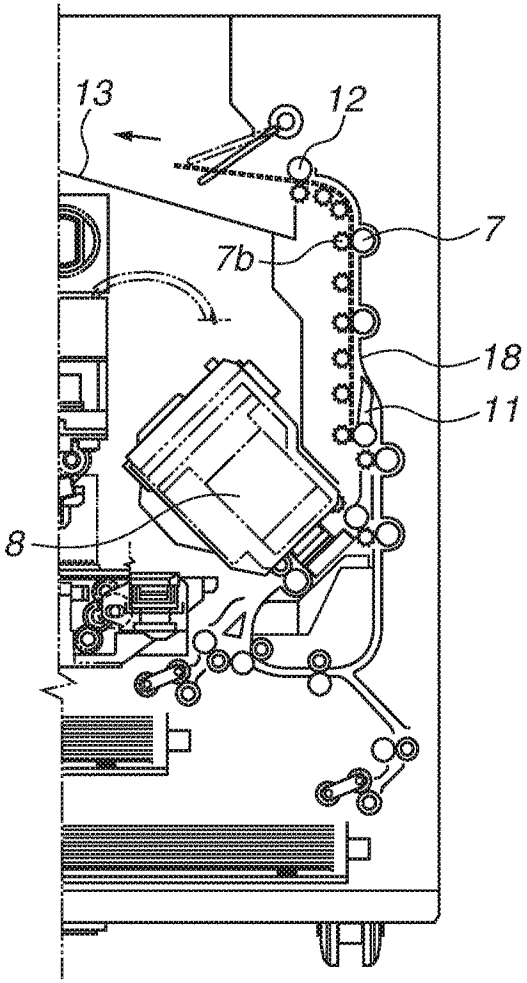
FIGS. 5A to 5C are diagrams each illustrating a conveyance route of a recording medium fed from a second cassette.
Figure 5B:
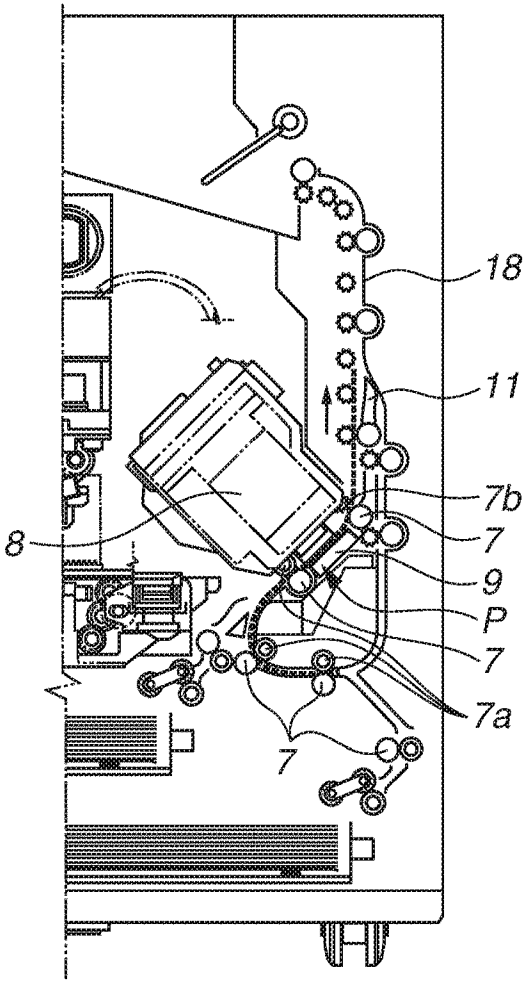
Figure 5A:
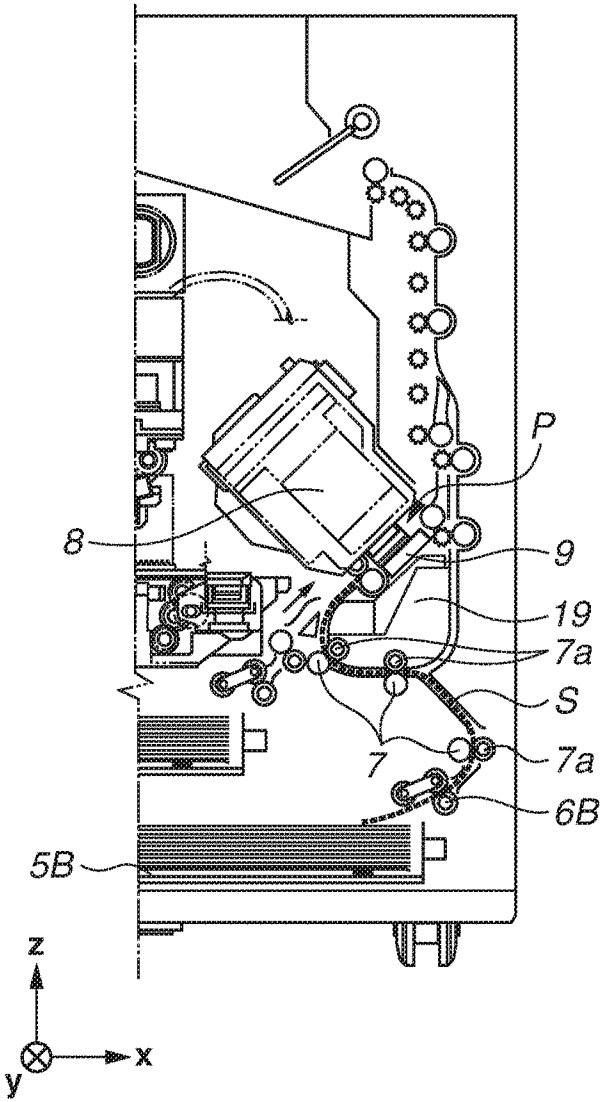

FIGS. 5A to 5C illustrate a conveyance route for feeding the A3-size recording mediums S stored in the second cassette 5B. The uppermost recording medium S stacked in the second cassette 5B is separated from the second and subsequent recording mediums by the second sheet feeding unit 6B and is conveyed toward the recording region P between the platen 9 and the recording head 8 while being nipped by the conveyance rollers 7 and the pinch rollers 7*a*.

FIG. 5A illustrates the conveyance state immediately before the leading edge of the recording medium S reaches the recording region P. The plurality of conveyance rollers 7, the pinch rollers 7*a*, and the inner guide 19 are provided in the conveyance route from the point at which the recording medium S is fed by the second sheet feeding unit 6B to the point at which the fed recording medium S reaches the recording region P so that the recording medium S is curved in an S shape and conveyed to the platen 9.

The conveyance route thereafter is the same as the conveyance route for the A4-size recording mediums S in FIGS. 4B and 4C. FIG. 5B illustrates the state in which the leading edge of the recording medium S is passed through the recording region P and is conveyed upward in the vertical direction. FIG. 5C illustrates the state in which the leading edge of the recording medium S is ejected into the sheet ejection tray 13.

FIGS. 6A to 6D illustrate the conveyance route in the case in which a recording operation (two-sided recording) is performed on the back surface (second surface) of the A4-size recording medium S. In the case in which the recording apparatus 1 performs two-sided recording, the recording apparatus 1 performs a recording operation on a first surface (front surface) and then on a second surface (back surface). The conveyance process in the recording on the first surface is similar to that in FIGS. 4A to 4C, so that description thereof is omitted. The conveyance process following FIG. 4C will be described below.

Figures 6A, 6B, 6C, 6D:
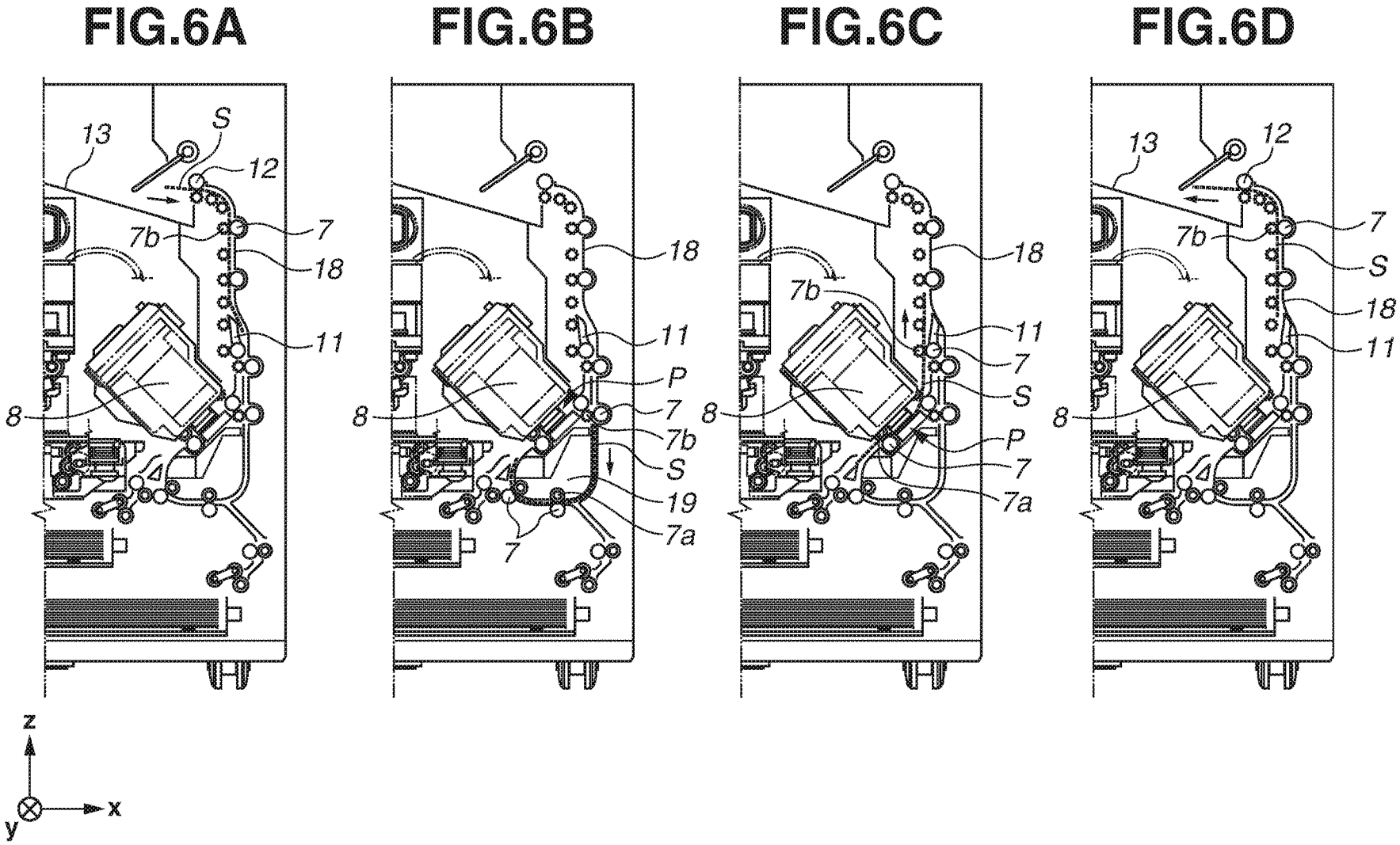
FIGS. 6A to 6D are diagrams each illustrating a conveyance route in a case in which a recording operation is performed on the back surface of a recording medium.

If the recording head 8 completes the recording operation on the first surface and the tail edge of the recording medium S is passed through the flapper 11, the print controller 202 rotates the conveyance rollers 7 backward to convey the recording medium S to the inside of the recording apparatus 1. At this time, the leading edge of the flapper 11 is controlled to incline leftward in FIG. 6 by an actuator (not illustrated), so that the leading edge (which is the tail edge in the recording operation on the first surface) of the recording medium S is passed through the right-hand side of the flapper 11 and conveyed downward in the vertical direction. FIG. 6A illustrates the state in which the leading edge (i.e., the tail edge in the recording operation on the first surface) of the recording medium S is passed through the right-hand side of the flapper 11.

Thereafter, the recording medium S is conveyed along the curved outer surface of the inner guide 19 and conveyed again to the recording region P between the recording head 8 and the platen 9. At this time, the second surface of the recording medium S faces the discharge opening surface 8*a* of the recording head 8. FIG. 6B illustrates the conveyance state immediately before the leading edge of the recording medium S reaches the recording region P for the recording operation on the second surface.

The conveyance route thereafter is similar to that in the recording on the first surface as illustrated in FIGS. 4B and 4C. FIG. 6C illustrates the state in which the leading edge of the recording medium S is passed through the recording region P and conveyed upward in the vertical direction. At this time, the flapper 11 is controlled by the actuator (not illustrated) to move to a position such that the leading edge of the flapper 11 is inclined rightward. FIG. 6D illustrates the state in which the leading edge of the recording medium S is passed through the sheet ejection roller 12 and ejected onto the sheet ejection tray 13. A similar conveyance process is performed in the two-sided recording on the A3-size recording mediums S.

Next, a maintenance operation on the recording head 8 will be described below. As described above with reference to FIG. 1, the maintenance unit 16 includes the cap unit 10 and the wiping unit 17 and causes the units to perform maintenance operations at predetermined timings.

Figure 7:
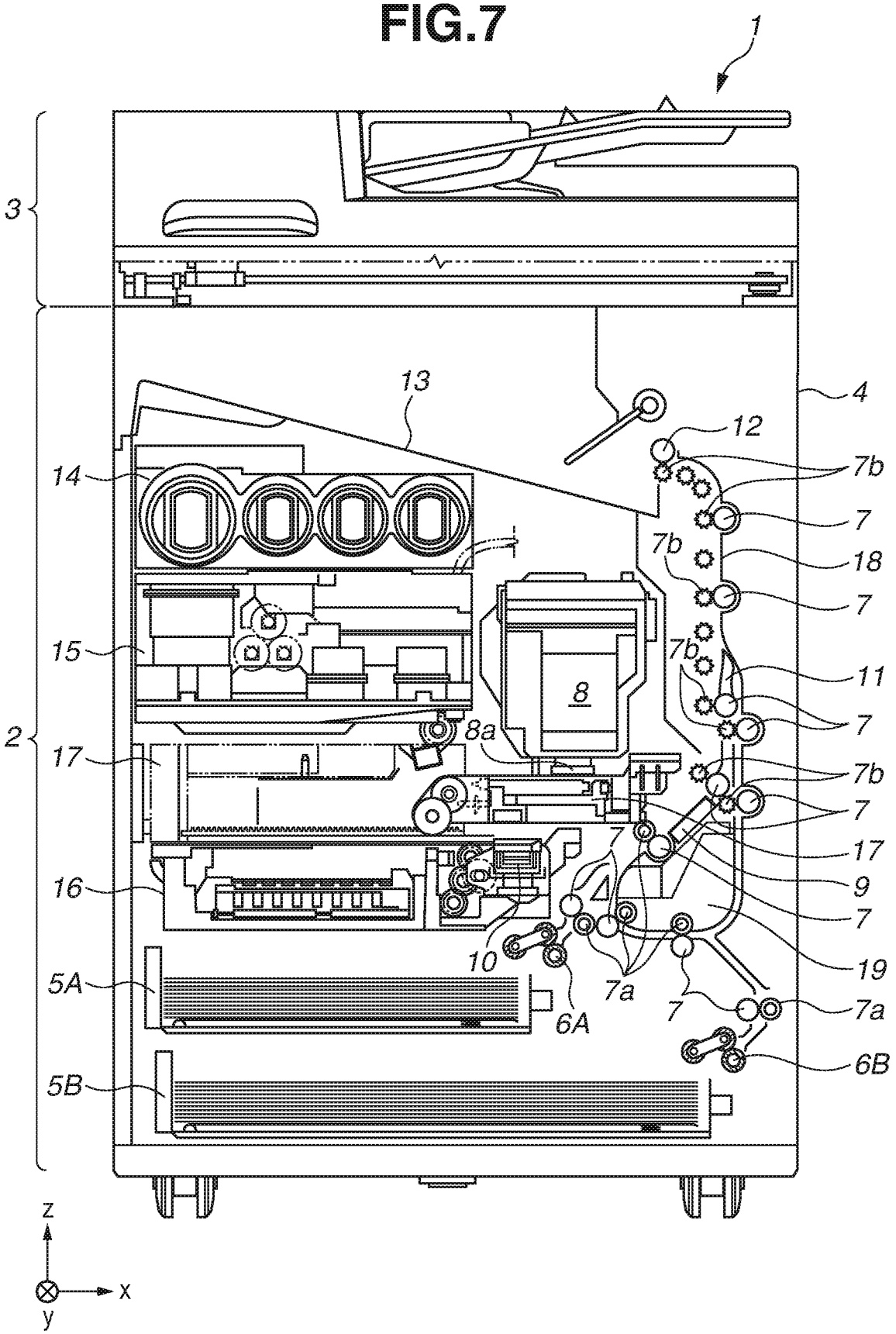
FIG. 7 illustrates the inkjet recording apparatus in a maintenance state.

FIG. 7 illustrates the recording apparatus 1 in the maintenance state. To move the recording head 8 from the standby position illustrated in FIG. 1 to the maintenance position illustrated in FIG. 7, the print controller 202 first moves the recording head 8 diagonally upward in the vertical direction and moves the cap unit 10 downward in the vertical direction. Then, the print controller 202 moves the wiping unit 17 from the retracted position to the right direction as illustrated in FIG. 7. Thereafter, the print controller 202 moves the recording head 8 downward in the vertical direction to the maintenance position to enable a maintenance operation.

To move the recording head 8 from the recording position illustrated in FIG. 3 to the maintenance position illustrated in FIG. 7, on the other hand, the print controller 202 first moves the recording head 8 upward in the vertical direction while rotating the recording head 8 by about 45 degrees. Then, the print controller 202 moves the wiping unit 17 from the retracted position to the right direction. Thereafter, the print controller 202 moves the recording head 8 downward in the vertical direction to the maintenance position to enable a maintenance operation by the maintenance unit 16.

Figure 8A:
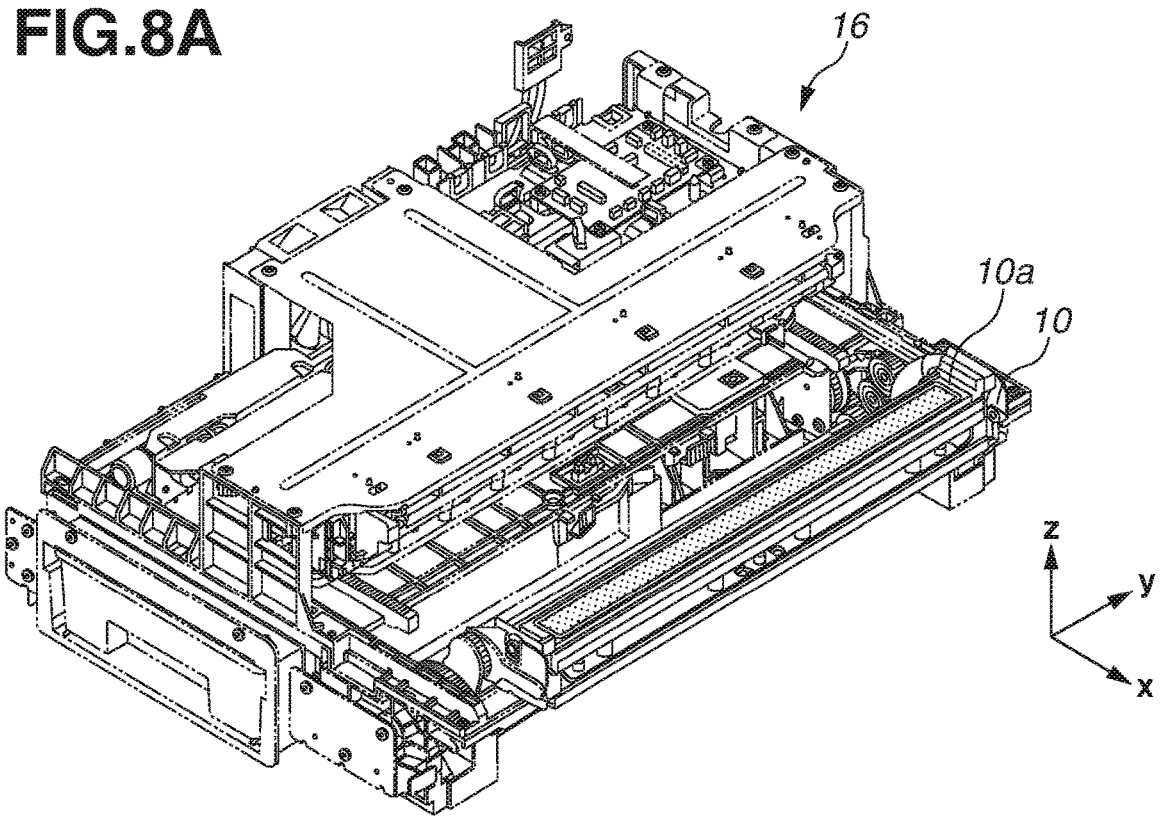
FIGS. 8A and 8B are perspective views illustrating a structure of a maintenance unit.
Figure 8B:
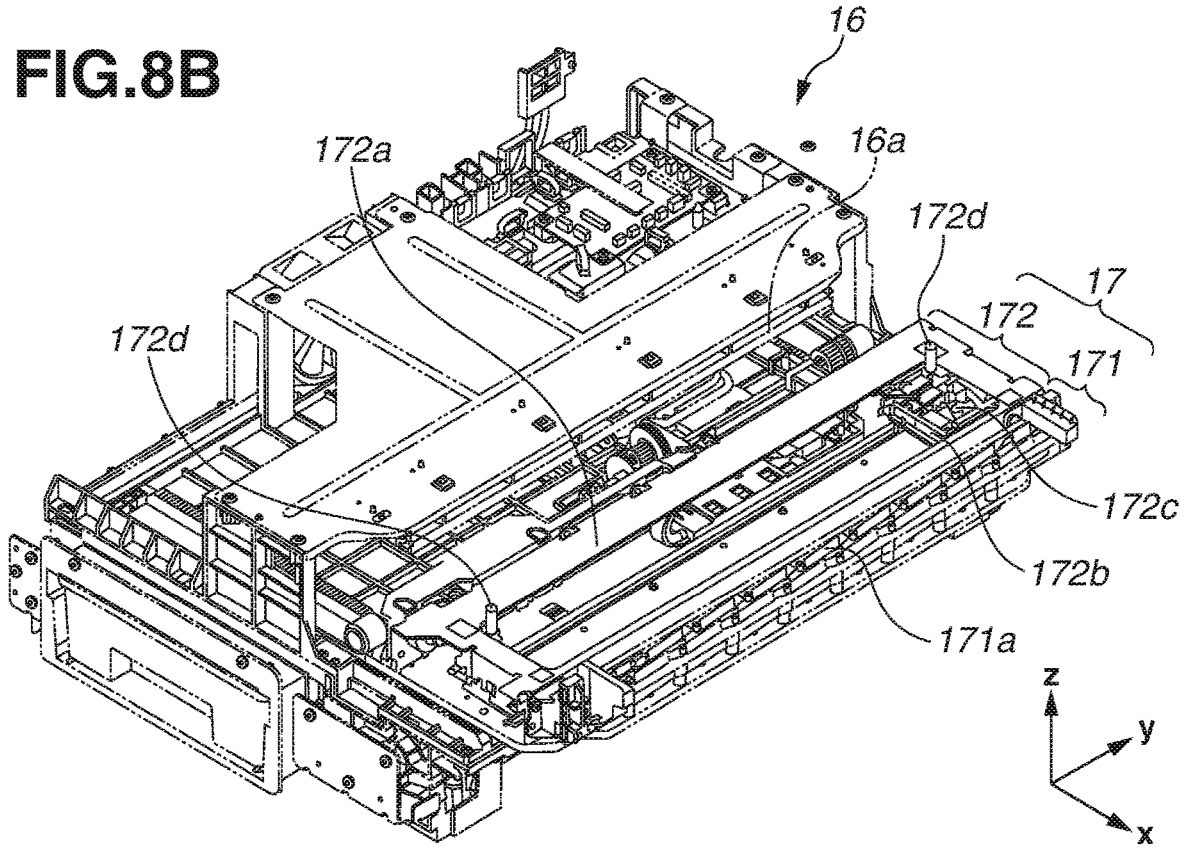

FIG. 8A is a perspective view illustrating the maintenance unit 16 in the standby position, and FIG. 8B is a perspective view illustrating the maintenance unit 16 in the maintenance position. FIG. 8A corresponds to the position of the maintenance unit 16 illustrated in FIG. 1, and FIG. 8B corresponds to the position of the maintenance unit 16 illustrated in FIG. 7. When the recording head 8 is in the standby position, the maintenance unit 16 is in the standby position illustrated in FIG. 8A, the cap unit 10 is in the capping position, and the wiping unit 17 is stored in the maintenance unit 16. The cap unit 10 includes the cap member 10*a*, which extends in the y-direction and is box-shaped, and the cap member 10*a* is closely appressed to the discharge opening surface 8*a* of the recording head 8 to prevent evaporation of ink from the discharge openings. Further, the cap unit 10 also has the function of collecting ink discharged to the cap member 10*a* by preliminary discharge or the like and causing a suction pump (not illustrated) to suction the collected ink.

On the other hand, in the maintenance position illustrated in FIG. 8B, the cap unit 10 has been moved to the retracted position located downward in the vertical direction, and the wiping unit 17 is removed from the maintenance unit 16. The wiping unit 17 includes two wiper units, i.e., a blade wiper unit 171 and a vacuum wiper unit 172.

The blade wiper unit 171 includes a blade wiper 171*a* for wiping the discharge opening surface 8*a* along the x-direction. The blade wiper 171*a* is provided in the y-direction over the length corresponding to the region where the discharge openings are aligned. When a wiping operation is performed using the blade wiper unit 171, the wiping unit 17 moves the blade wiper unit 171 in the x-direction in a state where the recording head 8 is positioned at the height at which the recording head 8 comes into contact with the blade wiper 171*a*. By this movement, the inks on the discharge opening surface 8*a* are wiped by the blade wiper 171*a*.

The opening of the maintenance unit 16 from which the blade wiper 171*a* is stored is provided with a wet wiper cleaner 16*a* for removing the inks on the blade wiper 171*a* and applying a wet liquid to the blade wiper 171*a*. In this way, each time the blade wiper 171*a* is stored in the maintenance unit 16, adhered substances on the blade wiper 171*a* is removed by the wet wiper cleaner 16*a* and the wet liquid is applied to the blade wiper 171*a* by the wet wiper cleaner 16*a*. Then, when the discharge opening surface 8*a* is wiped thereafter, the wet liquid is transferred onto the discharge opening surface 8*a* to improve the slipperiness between the discharge opening surface 8*a* and the blade wiper 171*a*.

Further, the vacuum wiper unit 172 includes a flat plate 172*a*, a carriage 172*b*, and a vacuum wiper 172*c*. The flat plate 172*a* includes an opening portion extending in the y-direction. The carriage 172*b* is movable in the opening portion in the y-direction. The vacuum wiper 172*c* is mounted on the carriage 172*b*. The vacuum wiper 172*c* is capable of wiping the discharge opening surface 8*a* in the y-direction along with the movement of the carriage 172*b*. A suction opening connected with the suction pump (not illustrated) is formed in the leading edge of the vacuum wiper 172*c*. Thus, if the carriage 172*b* is moved in the y-direction while the suction pump is operated, ink and other substances adhered on the discharge opening surface 8*a* of the recording head 8 are wiped by the vacuum wiper 172*c* and suctioned into a suction opening. At this time, positioning pins 172*d* provided to the respective end portions of the flat plate 172*a* and the opening portion are used to adjust the position of the discharge opening surface 8*a* with respect to the vacuum wiper 172*c*.

Figure 9:
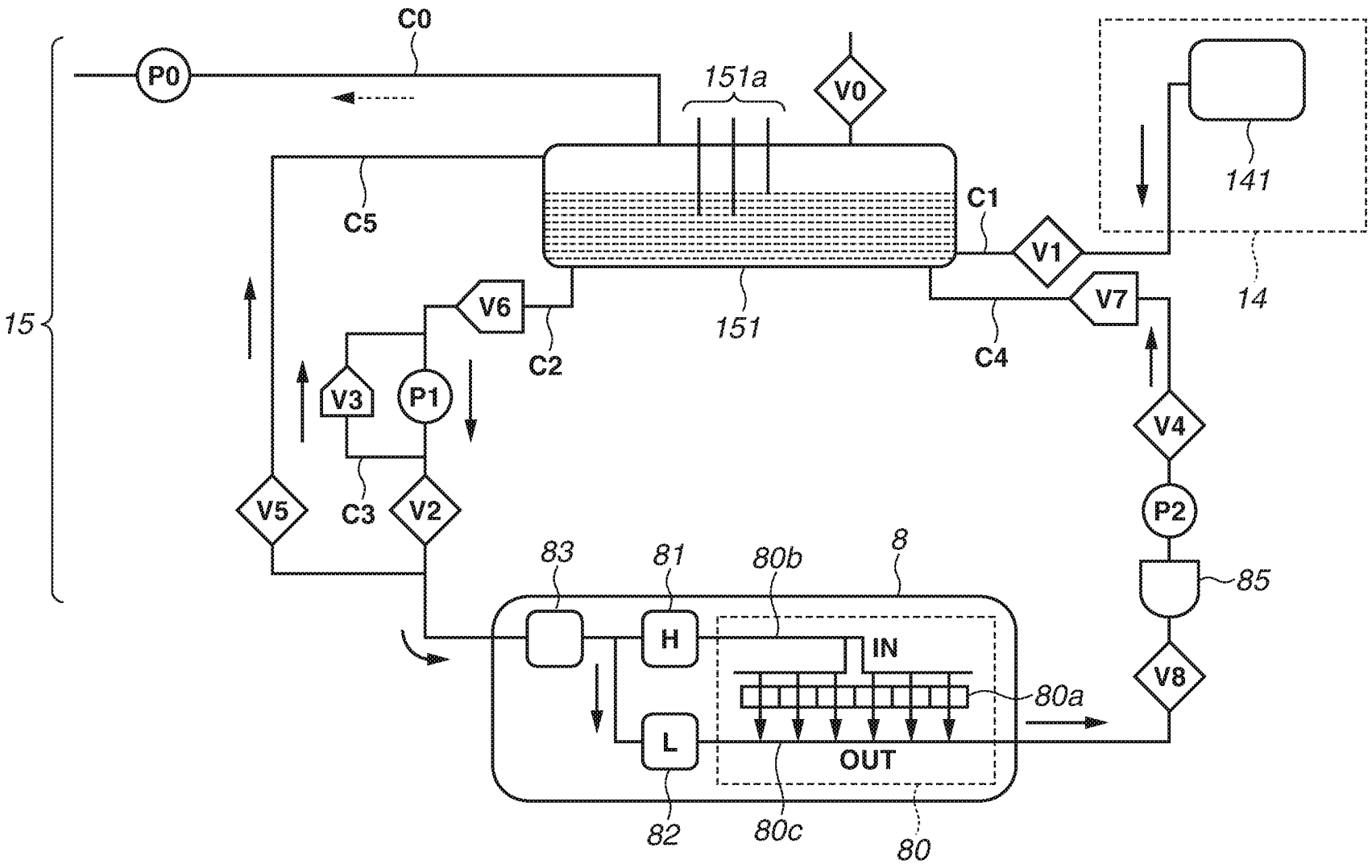
FIG. 9 is a schematic view illustrating an ink supply unit.

FIG. 9 illustrates the ink supply unit 15 used in the recording apparatus 1. The ink supply unit 15 is configured to supply ink from the ink tank unit 14 to the recording head 8. While the configuration with respect to one ink color is described, a similar configuration is provided for each ink color. The ink supply unit 15 is controlled basically by the ink supply control unit 209 illustrated in FIG. 2. The configurations of the respective units will be described below.

The ink is circulated mainly between a sub-tank (ink tank) 151 and the recording head 8 (head unit 8 in FIGS. 9 to 16). The head unit 8 performs an ink discharge operation based on image data, and the ink that is not discharged is collected again by the sub-tank 151.

The sub-tank 151 which stores a predetermined amount of ink is connected with a supply channel C2 for supplying the ink to the head unit 8 and a collection channel C4 for collecting the ink from the head unit 8. Specifically, the sub-tank 151, the supply channel C2, the head unit 8, and the collection channel C4 form a circulation route through which the ink is circulated.

The sub-tank 151 is provided with a liquid surface detection member 151*a* including a plurality of pins, and the ink supply control unit 209 detects the presence/absence of conduction current between the plurality of pins to detect the height of the ink surface, i.e., the amount of remaining ink in the sub-tank 151. The sub-tank 151 to which the ink is supplied includes an ink chamber and an air chamber. The ink chamber is located in the lower part of the sub-tank 151 where ink is accumulated. The air chamber is located in the upper part of the sub-tank 151 where no ink is accumulated. A vacuum pump P0 is a negative pressure generation source for reducing the pressure in the sub-tank 151. An atmospheric air communication valve V0 is a valve to allow or not to allow the inside of the sub-tank 151 to communicate with the atmospheric air.

A main tank 141 is a tank which stores the ink to be supplied to the sub-tank 151. The main tank 141 includes a flexible member, and the sub-tank 151 is filled with the ink according to change in the volume of the flexible member. The main tank 141 is attachable to and removable from the main body of the recording apparatus 1. A tank connection channel C1 connecting the sub-tank 151 and the main tank 141 to each other is provided with a tank supply valve V1 for opening/closing the connection between the sub-tank 151 and the main tank 141, and the tank supply valve V1 is disposed between the sub-tank 151 and the main tank 141.

With the above-described configuration, the ink supply control unit 209 closes the atmospheric air communication valve V0, a supply valve V2, a collection valve V4, and a head exchange valve V5 if the liquid surface detection member 151*a* detects that the ink in the sub-tank 151 is less than a predetermined amount. In this state, the ink supply control unit 209 opens the tank supply valve V1 and operates the vacuum pump P0. Consequently, the pressure inside of the sub-tank 151 becomes negative, and then the ink is supplied from the main tank 141 to the sub-tank 151. If the liquid surface detection member 151*a* detects that the ink in the sub-tank 151 exceeds the predetermined amount, the ink supply control unit 209 closes the tank supply valve V1 and stops the vacuum pump P0.

The supply channel C2 is a channel for supplying the ink from the sub-tank 151 to the head unit 8, and a first check valve V6, a supply pump P1, and the supply valve V2 are disposed in this order from the side closer to the sub-tank 151 between the sub-tank 151 to the head unit 8. The first check valve V6 is a one-way valve which allows ink to flow only in one direction from the sub-tank 151 to the head unit 8 and regulates flow of ink in the opposite direction. The first check valve V6 is opened or closed according to a difference in pressure between the upstream and downstream sides. Specifically, if a predetermined difference in pressure occurs between the upstream and downstream sides of the first check valve V6, the first check valve V6 is opened to allow the supply of ink from the sub-tank 151 to the head unit 8. The first check valve V6 is a valve for preventing the ink in the supply channel C2 from being drawn into the sub-tank 151 when the vacuum pump P0 is driven to reduce the pressure in the sub-tank 151. The first check valve V6 also serves in the role of controlling the pressure in the ink flow channel using the pressure difference for opening and closing the valve. The reduction of pressure in the sub-tank 151 is performed not only in the above-described case of filling the sub-tank 151 with the ink from the main tank 141 but also in the case of performing a deaeration operation to deaerate the ink in the channel so that formation of bubbles is prevented.

The supply valve V2 is a driving-type valve and is opened during a recording operation performed by the head unit 8. The supply valve V2 is closed to fill the part of the supply channel C2 that is downstream of the supply valve V2 and the inside of the head unit 8 with the ink by suction from the discharge openings in a state where the head unit 8 is capped with the cap unit 10. Specifically, the supply valve V2 and a buffer chamber shut-off valve V8 described below are closed to form a closed space between the supply valve V2 and the head unit 8, and a negative pressure is charged into the closed space by suction. After the negative pressure is charged for a predetermined time, the supply valve V2 is opened so that the inside of the head unit 8 is filled with the ink due to the charged large negative pressure (choke suction). Further, a similar suction operation is performed to defoam the ink in the channel between the supply valve V2 and the buffer chamber shut-off valve V8.

During a recording operation, the supply pump P1 is driven in a state where the supply valve V2 is opened, so that the ink is circulated through the circulation route while the ink is supplied to the head unit 8. The amount of ink consumed by the head unit 8 per unit time varies depending on image data. Thus, the flow rate of the supply pump P1 is set such that the flow rate is also able to accommodate a case of performing a discharge operation in which the amount of ink consumption per unit time in the head unit 8 reaches the maximum amount.

A relief channel (detour route) C3 is a channel with one end connected with a portion between the first check valve V6 and the supply pump P1 and the other end connected with a portion between the supply pump P1 and the supply valve V2, and a relief valve V3 which is a differential pressure valve is provided in the relief channel C3. If the amount of ink supply from the supply pump P1 per unit time is greater than the total value of the amount of discharge of the head unit 8 per unit time and the flow rate of a collection pump P2 per unit time, a pressure is applied to the relief valve V3 to open the relief valve V3. Consequently, a cyclic channel is formed by a part of the supply channel C2 and the relief channel C3. The above-described structure of the relief channel C3 is provided so that the amount of ink supply to the head unit 8 is adjusted according to the amount of ink consumption in the head unit 8 to stabilize the fluid pressure in the circulation route regardless of image data.

The collection channel C4 is a channel for collecting the ink from the head unit 8 to the sub-tank 151, and a second check valve V7, the collection valve V4, the collection pump P2, a buffer chamber 85, and the buffer chamber shut-off valve V8 are disposed in the collection channel C4 in this order from the side closer to the sub-tank 151. To circulate the ink in the circulation route, the collection pump P2 becomes a negative pressure generation source and suctions the ink from the head unit 8. The collection pump P2 is driven so that a suitable difference in pressure is generated between an IN-channel 80*b* and an OUT-channel 80*c* in the head unit 8, and the ink flows from the IN-channel 80*b* to the OUT-channel 80*c*. Details of the channel structure in the head unit 8 will be described below.

The second check valve V7 is a one-way valve that allows the ink to flow only in one direction from the head unit 8 to the sub-tank 151 and regulates the flow of the ink in the opposite direction. The second check valve V7 is, in the similar manner to the first check valve V6, opened and closed according to a difference in pressure between the upstream and downstream sides of the second check valve V7. Specifically, if a difference in pressure occurs between the upstream and downstream sides of the second check valve V7, the second check valve V7 is opened to allow the ink to be collected from the head unit 8 into the sub-tank 151.

The second check valve V7 is a valve that prevents the ink from flowing from the sub-tank 151 into the head unit 8 through the collection channel C4 when no recording operation is performed, i.e., when no ink is circulated in the circulation route. In the circulation route of the present example embodiment, the sub-tank 151 is disposed above the head unit 8 in the vertical direction (refer to FIG. 1). Thus, when the supply pump P1 and the collection pump P2 are not driven, the ink can flow backward from the sub-tank 151 to the head unit 8 due to a water head difference between the sub-tank 151 and the head unit 8. To prevent such a backward flow, the second check valve V7 is provided to the collection channel C4 in the present example embodiment.

The collection valve V4 is a driving-type valve for preventing the ink in the collection channel C4 from being caught into the sub-tank 151 when the vacuum pump P0 is driven to reduce the pressure in the sub-tank 151.

The buffer chamber 85 includes a spring, which is a biasing member, and a flexible member, and the volume of the buffer chamber 85 is changeable. The flexible member is biased by the spring in the direction in which the volume of the buffer chamber 85 expands. When bubbles are mixed in the ink in the head unit 8 and the collection channel C4, the buffer chamber 85 plays the role of absorbing changes in volume due to the expansion and contraction of the bubbles to maintain the negative pressure in the channel at a constant level (maintain the pressure within a suitable range). In this way, the meniscus in the head unit 8 is maintained to prevent the ink from leaking from the head unit 8 and prevent the air from being drawn into the discharge openings.

The buffer chamber shut-off valve V8 is disposed between the head unit 8 and the buffer chamber 85. The buffer chamber shut-off valve V8 is closed during the choke suction described above to play the role of preventing the ink to be suctioned and ejected through the cap unit 10 from flowing into the collection channel C4.

Next, a head exchange channel (first channel) C5 is a channel that connects the supply channel C2 and an air chamber (space storing no ink) of the sub-tank 151 to each other, and the head exchange valve V5 is disposed in the head exchange channel C5. One of the ends of the head exchange channel C5 is connected with a portion of the supply channel C2 that is upstream of the head unit 8, and the other one of the ends is connected with an upper portion of the sub-tank 151 to communicate with the inside air chamber. The head exchange channel C5 is used to collect the ink from the head unit 8 in use at the time of replacing the head unit 8, transporting the recording apparatus 1, and other operations.

The head exchange valve V5 is controlled by the ink supply control unit 209 such that head exchange valve V5 is closed during a period other than the time of initial filling of the recording apparatus 1 with the ink and the time of collecting the ink from the head unit 8. The head exchange channel C5 is connected with a portion of the supply channel C2 that is downstream of the supply valve V2. Specifically, the supply valve V2 described above is provided in the supply channel C2 between the portion connected with the head exchange channel C5 and the portion connected with the relief channel C3.

While the structure in which the first check valve V6 is provided to the supply channel C2 has been described in the present example embodiment, the first check valve V6 does not have to be provided. When the vacuum pump P0 is driven to reduce the pressure in the sub-tank 151, the supply valve V2 is closed to prevent the ink in the supply channel C2 from being drawn into the sub-tank 151. Similarly, a structure in which the second check valve V7 is not provided can be employed. The collection valve V4 is closed to prevent the ink from flowing backward from the sub-tank 151 to the head unit 8.

Next, the channel structure in the head unit 8 will be described below. The ink supplied from the supply channel C2 to the head unit 8 is passed through a filter 83 and thereafter supplied to a first negative pressure control unit (first pressure control unit) 81, which generates a small negative pressure, and a second negative pressure control unit (second pressure control unit) 82, which generates a large negative pressure. Hereinafter, the first negative pressure control unit 81 and the second negative pressure control unit 82 are also referred to collectively as "negative pressure control unit". The absolute value of the pressure generated by the second negative pressure control unit 82 is smaller than the absolute value of the pressure generated by the first negative pressure control unit 81. The pressures in the first negative pressure control unit 81 and the second negative pressure control unit 82 are generated by the driving of the collection pump P2.

An ink discharge portion 80 includes a plurality of recording element substrates 80*a* in which the plurality of discharge openings is aligned to form a long discharge opening array. Each of the recording element substrates 80*a* includes a recording element 2323 (refer to FIG. 10B) which is a heat generation element for causing the ink to foam with the heat energy. A common supply channel 80*b* (IN-channel) for guiding the ink supplied from the first negative pressure control unit 81 and a common collection channel 80*c* (OUT-channel) for guiding the ink supplied from the second negative pressure control unit 82 also extend along the direction in which the plurality of recording element substrates 80*a* is aligned. The common supply channel 80*b* is connected with the supply channel C2. The common collection channel 80*c* is connected with the supply channel C2 and the collection channel C4.

Figure 10A:
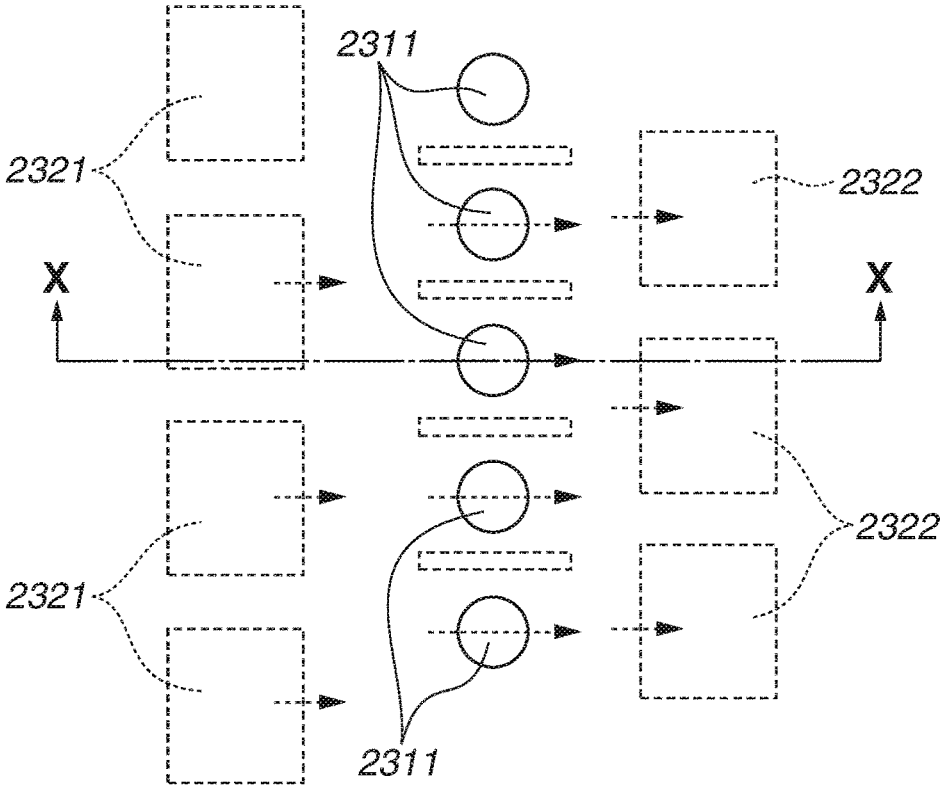
FIGS. 10A-B illustrate a structure of an ink discharge unit of a recording head (head unit).
Figure 10B:
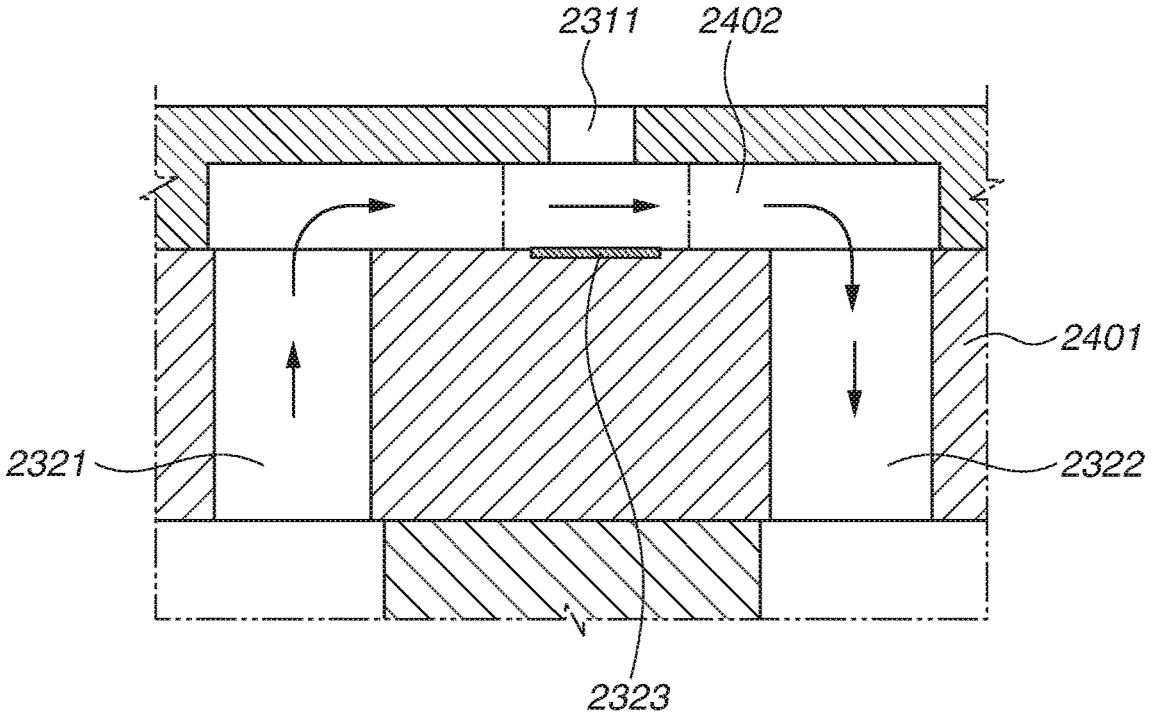

FIG. 10A is an enlarged schematic plan view illustrating a portion of the recording element substrates 80*a*, and FIG. 10B is a schematic cross-sectional view along the cross-sectional taken along line X-X specified in FIG. 10A. The recording element substrate 80*a* includes a pressure chamber 2402 to be filled with the ink and the discharge openings 2311 for discharging the ink. In the pressure chamber 2402, the recording element 2323 is provided in a position facing the discharge opening 2311. Further, the recording element substrate 80*a* includes a plurality of separate supply channels 2321 connected with the common supply channel 80*b* and a plurality of separate collection channels 2322 connected with the common collection channel 80*c*.

The above-described structure generates the flow of the ink from the common supply channel 80*b* having a relatively small negative pressure (high pressure) into the common collection channel 80*c* having a relatively large negative pressure (low pressure) in the recording element substrates 80*a*. More specifically, the ink flows through the common supply channel 80*b*, the separate supply channel 2321, the pressure chamber 2402, the separate collection channel 2322, and the common collection channel 80*c* in this order. If the ink is discharged by the recording element 2323, some of the ink that moves from the common supply channel 80*b* to the common collection channel 80*c* is discharged from the discharge openings 2311 to be ejected therefrom, whereas the ink that is not discharged moves through the common collection channel 80*c* to the collection channel C4. Alternatively, the recording element substrate 80*a* may be configured not to include the common collection channel 80*c*, the separate supply channel 2321 or the separate collection channel 2322. In such a configuration, the common supply channel 80*b* is directly connected with the collection channel C4 such that the ink is collected from the common supply channel 80*b*.

Figure 11A:
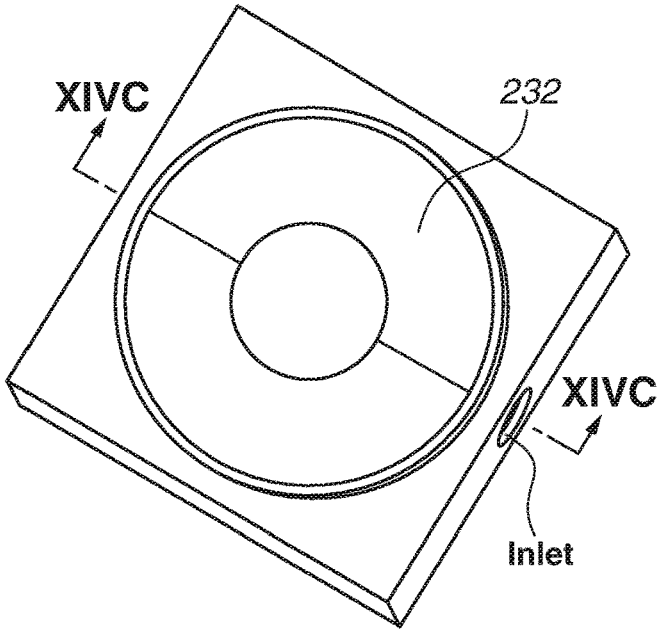
FIG. 11A-C illustrate a structure of a first negative pressure control unit of the recording head (head unit).
Figure 11B:
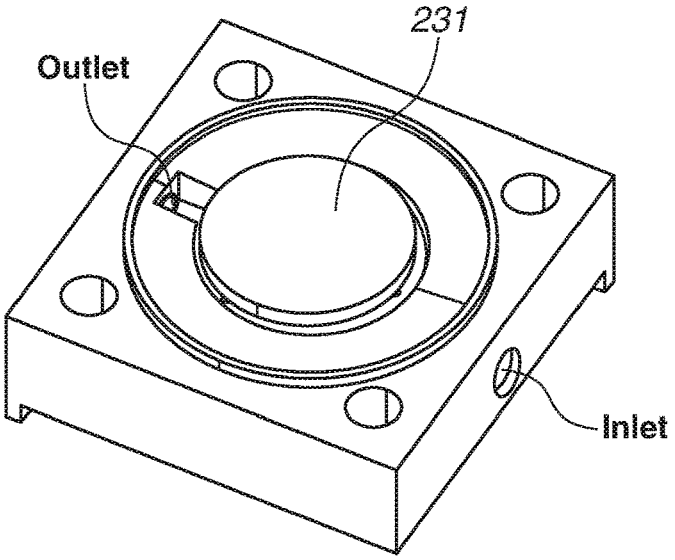
Figure 11C:
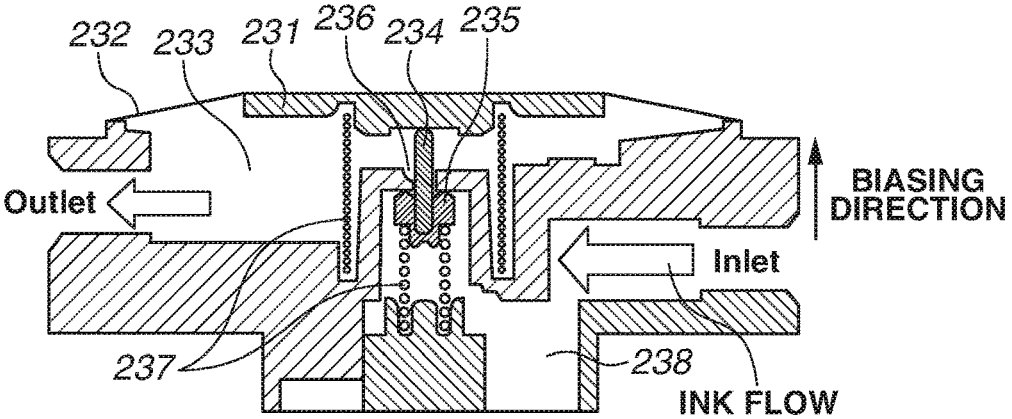

FIGS. 11A to 11C illustrate the first negative pressure control unit 81 provided in the head unit 8. FIGS. 11A and 11B are external perspective views. FIG. 11B illustrates the inside of the first negative pressure control unit 81 without the illustration of a flexible film 232. FIG. 11C illustrates the cross section taken along line XIVC-XIVC specified in FIG. 11A. The first negative pressure control unit 81 and the second negative pressure control unit 82 are differential pressure valves having a similar structure except for the difference in control pressure (initial load of the spring), so that description of the second negative pressure control unit 82 is omitted.

In the first negative pressure control unit 81, a first pressure chamber 233 is formed by a pressure reception plate 231 illustrated in FIG. 11B and a flexible film 232 sealing the space around the pressure reception plate 231. The flexible film 232 is welded to the circular edge illustrated in FIG. 11B and the pressure reception plate 231. The flexible film 232 and the pressure reception plate 231 welded to the flexible film 232 are displaced upward or downward according to an increase or decrease in the ink in the first pressure chamber 233.

A second pressure chamber 238 connected with the supply pump P1, a shaft 234 coupled to the pressure reception plate 231, a valve 235 coupled to the shaft 234, and an orifice 236 being in contact with the valve 235 are provided on the upstream side of the first pressure chamber 233 in the direction in which the ink is supplied. The orifice 236 in the present example embodiment is formed in the boundary of the first pressure chamber 233 and the second pressure chamber 238. Further, the valve 235, the shaft 234, and the pressure reception plate 231 are biased upward in the vertical direction by a biasing member (spring) 237.

If the absolute value of the pressure in the first pressure chamber 233 is equal to or greater than a first threshold value (if the negative pressure is smaller than the first threshold value), the valve 235 is brought into contact with the orifice 236 by the biasing force of the biasing member 237 to block the connection between the first pressure chamber 233 and the second pressure chamber 238. On the other hand, if the absolute value of the pressure in the first pressure chamber 233 is less than the first threshold value, i.e., if a larger negative pressure than the first threshold value is applied to the first pressure chamber 233, the flexible film 232 is contracted and displaced downward. In this way, the pressure reception plate 231 and the valve 235 are displaced downward against the biasing by the biasing member 237, and the valve 235 and the orifice 236 are separated to connect the first pressure chamber 233 and the second pressure chamber 238 with each other. This connection causes the ink supplied by the supply pump P1 to flow into the first pressure chamber 233.

The first negative pressure control unit 81 has the structure of the differential pressure valve described above to control the inflow pressure and outflow pressure to maintain the inflow pressure and outflow pressure constant. To generate a larger negative pressure than that generated by the first negative pressure control unit 81, the second negative pressure control unit 82 employs the biasing member 237 having a greater biasing force than the first negative pressure control unit 81. Specifically, in the second negative pressure control unit 82, the valve is opened if the pressure becomes less than a second threshold value which has a smaller absolute value of the pressure than the first threshold value. Thus, if the collection pump P2 is driven, first, the first negative pressure control unit 81 is changed from the closed state to the opened state, and then the second negative pressure control unit 82 is changed from the closed state to the opened state.

When a recording operation is performed with the ink supply unit 15 and the head unit 8 having the above-described structures, the ink supply control unit 209 closes the tank supply valve V1 and the head exchange valve V5 and opens the atmospheric air communication valve V0, the supply valve V2, and the collection valve V4. In this state, the ink supply control unit 209 drives the supply pump P1 and the collection pump P2. As a result of driving the supply pump P1 and the collection pump P2, there arises a predetermined pressure difference in the channel, so that the first check valve V6 and the second check valve V7 are opened to allow the ink to flow. In this way, the circulation route of the sub-tank 151, the supply channel C2, the head unit 8, the collection channel C4, and the sub-tank 151 in this order is established. If the amount of ink supply from the supply pump P1 per unit time is greater than the total value of the amount of discharge of the head unit 8 per unit time and the flow rate of the collection pump P2 per unit time, a predetermined pressure is applied to the relief valve V3 to open the relief valve V3. Consequently, the ink flows from the supply channel C2 into the relief channel C3. In this way, the excessively-supplied ink flows into the relief channel C3 to adjust the flow rate of the ink that flows from the supply channel C2 into the head unit 8.

Figure 12:
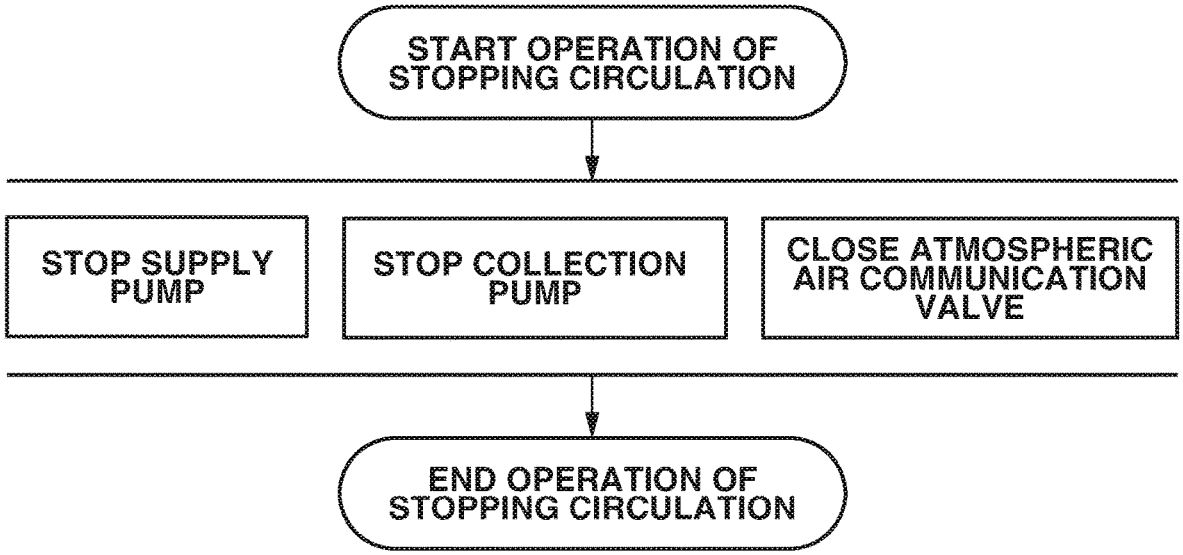
FIG. 12 is a flowchart illustrating control for changing the inkjet recording apparatus from the recording state to the waiting state.

FIG. 12 illustrates a sequence of stopping an ink circulation after an end of a recording operation and changing the recording apparatus 1 to the waiting state which is a provisional pause state. Specifically, the waiting state is a state in which a recording operation can be started immediately after a recording instruction is received, and the pause state is a state in which the recording apparatus 1 has been unoperated for a long time. If a recording operation is completed, the print controller 202 moves the head unit 8 to the standby position using the maintenance control unit 210 and the head carriage control unit 208. In other words, the head unit 8 is capped with the cap unit 10. In the ink supply unit 15, as illustrated in FIG. 12, the ink supply control unit 209 stops the supply pump P1 and the collection pump P2. In this way, the flow of the ink from the sub-tank 151 into the head unit 8 is prevented. Further, the ink supply control unit 209 closes the atmospheric air communication valve V0 to prevent evaporation of the ink in the sub-tank 151. In the case of a structure without the first check valve V6 and the second check valve V7, the ink supply control unit 209 closes the supply valve V2 and the collection valve V4 to prevent the flow of the ink from the sub-tank 151 into the head unit 8 due to a water head difference.

At this time, between the collection pump P2 and the second check valve V7, the difference in pressure is decreased due to the stop of the collection pump P2, and the second check valve V7 is changed to the closed state. On the upstream side of the collection pump P2, the buffer chamber 8 is biased by the spring in the direction where the volume of the buffer chamber 8 expands, so that the suction force for sucking the ink into the buffer chamber 8 acts thereon. At this time, on the downstream side of the buffer chamber 8, the second check valve V7 is in the closed state, so that the ink is not sucked by the buffer chamber 8. Consequently, the ink is sucked by the buffer chamber 8 from the channel between the head unit 8 disposed on the upstream of the buffer chamber 8 and the sub-tank 151. If the pressure in the ink flow channel is balanced by the suction of the ink by the buffer chamber 8, the pressure difference is decreased, and the first check valve V6 is closed. As a result, the change in volume of the buffer chamber 85 due to the suction of the ink ceases. In the present example embodiment, since the pressure at which the first check valve V6 is closed is smaller than the first threshold value, at least the first negative pressure control unit 81, out of the first negative pressure control unit 81 and the second negative pressure control unit 82, is maintained in the opened state. In the configuration that does not include the first check valve V6 and the second check valve V7, the supply valve V2 and the collection valve V4 are closed, so that the ink in the channel between the supply valve V2 and the collection valve V4 is sucked by the buffer chamber 8. Also in this case, at least the first negative pressure control unit 81, out of the first negative pressure control unit 81 and the second negative pressure control unit 82, is maintained in the opened state because the pressure after the volume change in the buffer chamber 8 is smaller than the first threshold value. The negative pressure maintained by the biasing member of the buffer chamber 8 is larger than that in the pause state described below. Further, the negative pressure maintained by the buffer chamber is smaller than the first threshold value, at least the first negative pressure control unit 81 is maintained in the opened state.

As described above, the recording apparatus 1 is changed to the waiting state while maintaining a part of the channel at a pressure equal to or lower than a predetermined pressure and maintaining at least the first negative pressure control unit 81, out of the first negative pressure control unit 81 and the second negative pressure control unit 82, in the opened state. In this way, the next time the recording apparatus 1 receives image data, the time (first print-out time (FPOT)) from the point at which the state is changed from the waiting state to the recording state (circulation state) to the point at which the recording operation on the first recording medium is ended can be reduced.

This point will be described below. To perform a recording operation, a predetermined negative pressure needs to be applied to the first negative pressure control unit 81 and the second negative pressure control unit 82 to change the valve 235 illustrated in FIG. 11C from the closed state to the opened state. To open the valve 235 of the second negative pressure control unit 82, the pressure in the first pressure chamber 233 needs to be smaller than the second threshold value, and it takes a predetermined time for the pressure to become smaller than the second threshold value after the driving of the collection pump P2 is started. However, use of the negative pressure due to a biasing member of the buffer chamber 85 as in the present example embodiment maintains a constant negative pressure, so that the time required to displace the valve 235 after the driving of the collection pump P2 is started can be reduced. This reduces the time of driving the collection pump P2 for a recording operation, so that the throughput until a start of recording improves.

Figure 13:
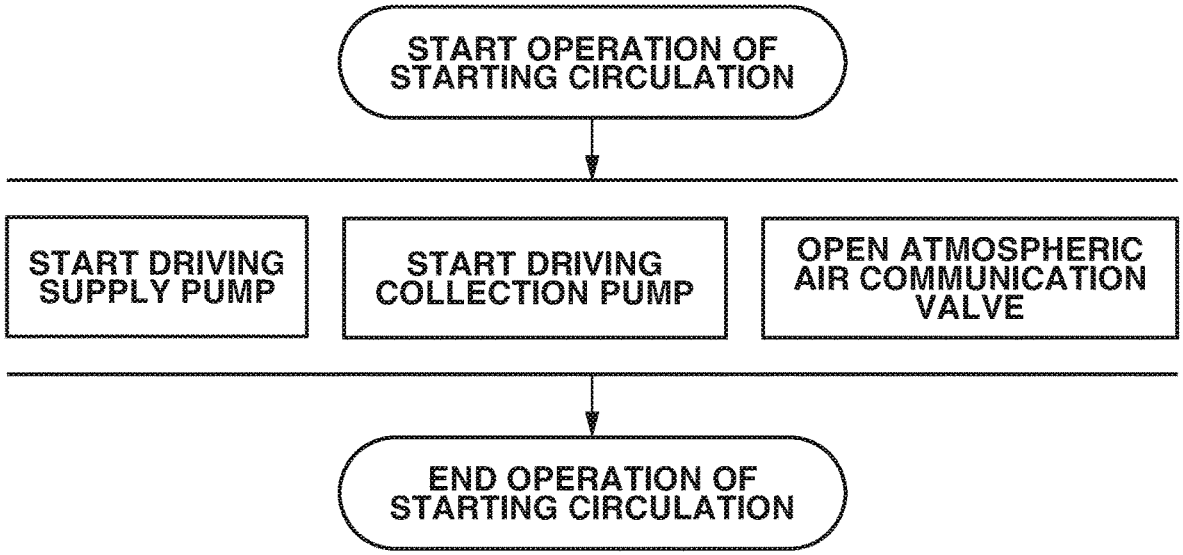
FIG. 13 is a flowchart illustrating control for changing the inkjet recording apparatus from the waiting state to the recording state.

FIG. 13 illustrates a sequence during a change from the waiting state to the recording state. If image data is received, the ink supply control unit 209 drives the supply pump P1 and the collection pump P2, and the atmospheric air communication valve V0 is opened. As a result of driving the supply pump P1 and the collection pump P2, the first check valve V6 and the second check valve V7 are also opened such that the circulation route is re-established. Specifically, since the first negative pressure control unit 81 and the channel on the downstream side of the second negative pressure control unit 82 is maintained at a pressure equal to or lower than the predetermined pressure, if the supply pump P1 and the collection pump P2 are driven, the circulation route is immediately established such that a recording operation is executable. As described above, when the recording apparatus 1 is changed from the waiting state to the recording state, the head unit 8 can start a recording operation about 2 to 2.5 seconds after the start of the circulation.

Figure 14:
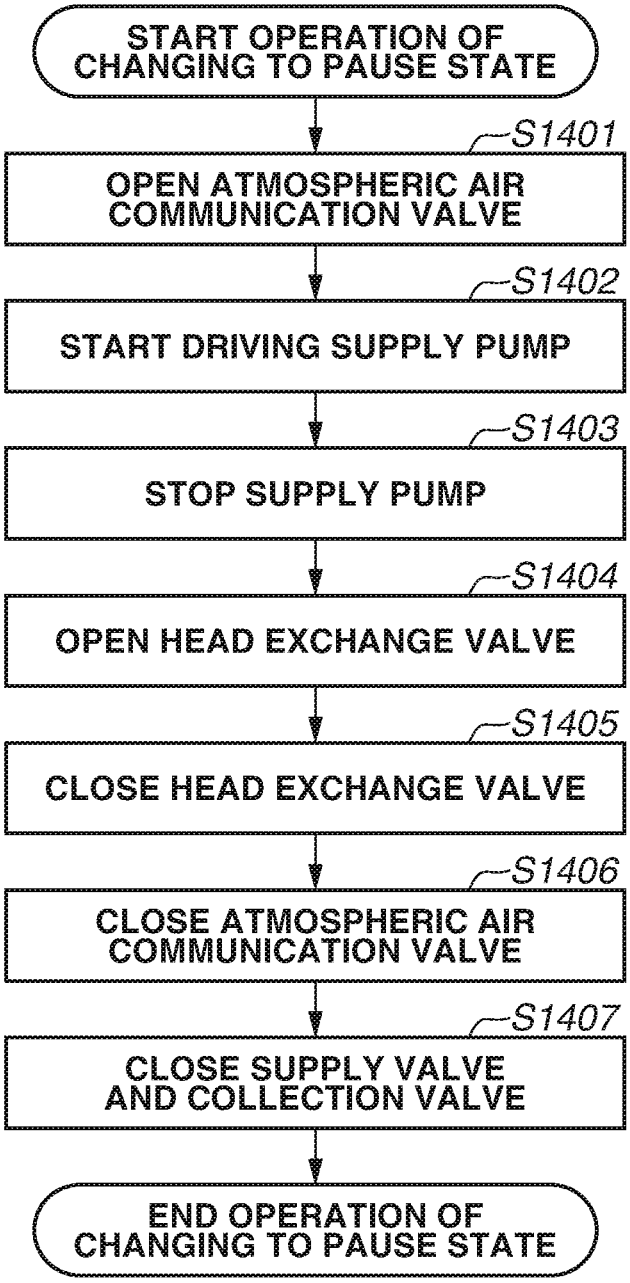
FIG. 14 is a flowchart illustrating control for changing the inkjet recording apparatus from the waiting state to a pause state.

FIG. 14 is a flowchart illustrating a process of changing the recording apparatus 1 from the waiting state to the pause state. If the recording apparatus 1 has been in the waiting state for a long time in the state where a slight amount of air bubbles is included in the head unit 8 and the channel, the air bubbles may expand and contract due to a change in ambient temperature. For example, the contraction of the buffer chamber 85 is developed when the ambient temperature decreases, and the negative pressure in the collection channel C4 can increase. Consequently, the air is easily drawn through the discharge openings 2311 into the channel. The buffer chamber 85 serves in the role of accommodating such an expansion and contraction of air bubbles. In the present example embodiment, the control is performed to change to the pause state if a predetermined time passes after the recording apparatus 1 is changed to the waiting state, and this prevents air from entering the channel even if the recording apparatus 1 has been unoperated for a long time. Also, in a case where the recording apparatus 1 is turned off by a user or detects an error while in the waiting state, the recording apparatus 1 is changed to the pause state. Further, in a case where the recording apparatus 1 is turned off or detects an error while in the recording state (circulation state), control may be performed such that the recording apparatus 1 is immediately changed to the pause state without passing through the waiting state. The positions of the head unit 8 and the maintenance unit 16, while the recording apparatus 1 is in the pause state, are similar to those in the waiting state illustrated in FIG. 1.

First, in step S1401, the ink supply control unit 209 opens the atmospheric air communication valve V0. In step S1402, the supply pump P1 is driven for a preset time (predetermined time). As a result of driving the supply pump P1, the first check valve V6 is opened, and the ink is pressure-supplied to the head unit 8. Since at least the first negative pressure control unit 81 is opened, the ink is supplied to the downstream side of the negative pressure control unit as a result of driving the supply pump P1. In this way, the volume of the buffer chamber 85 becomes larger and the pressure on the downstream side of the negative pressure control unit increases to weaken the negative pressure. The predetermined time for which the supply pump P1 is driven in step S1402 is set to a sufficient time for the volume of the buffer chamber 85 to increase such that the buffer chamber 85 can accommodate the expansion and contraction of bubbles in the channel that are caused by a change in ambient temperature. If the predetermined time passes, then in step S1403, the ink supply control unit 209 stops the supply pump P1.

In step S1404, the ink supply control unit 209 opens the head exchange valve V5. This enables the pressure increased by the pressure supply by the supply pump P1 to escape through the head exchange channel C5 into the sub-tank 151 which is in communication with the atmospheric air. Since the head exchange channel C5 is filled with the ink, the ink in the head exchange channel C5 is pushed into the sub-tank 151 by the increased pressure. As a result of the foregoing pressure adjustment, the pressures in the supply channel C2 and the head exchange channel C5 become substantially equal to the pressure of the atmospheric air.

Thereafter, in step S1405, the ink supply control unit 209 closes the head exchange valve V5, and in step S1406, the ink supply control unit 209 closes the atmospheric air communication valve V0. Further, in step S1407, the ink supply control unit 209 closes the supply valve V2 and the collection valve V4. The supply valve V2 and the collection valve V4 each include a diaphragm valve and are biased in the closing direction by a biasing member such as a spring. When the recording apparatus 1 is to be changed to the pause state, the supply valve V2 and the collection valve V4 are closed to prepare for the situation in which the recording apparatus 1 is unoperated for a long time, and this reduces the burden on the biasing member and the diaphragm. By the above-described control, the process of changing the recording apparatus 1 from the waiting state to the pause state is completed.

While the structure including the supply valve V2 and the collection valve V4 is described in the present example embodiment, the supply valve V2 and the collection valve V4 are not necessarily be included when the first check valve V6 and the second check valve V7 are provided. That is, only at least one of the first check valve V6 and the supply valve V2 and at least one of the second check valve V7 and the collection valve V4 need to be included to implement an example embodiment of the disclosure. While the example in which the predetermined time during the change from the waiting state to the pause state is an arbitrarily-set fixed value is described in the present example embodiment, the disclosure is not limited to the example. The recording apparatus 1 can include a sensor capable of measuring an environmental change (e.g., temperature change), and the predetermined time can be changed if air bubbles are likely to expand or contract according to measurement results.

Figure 15:
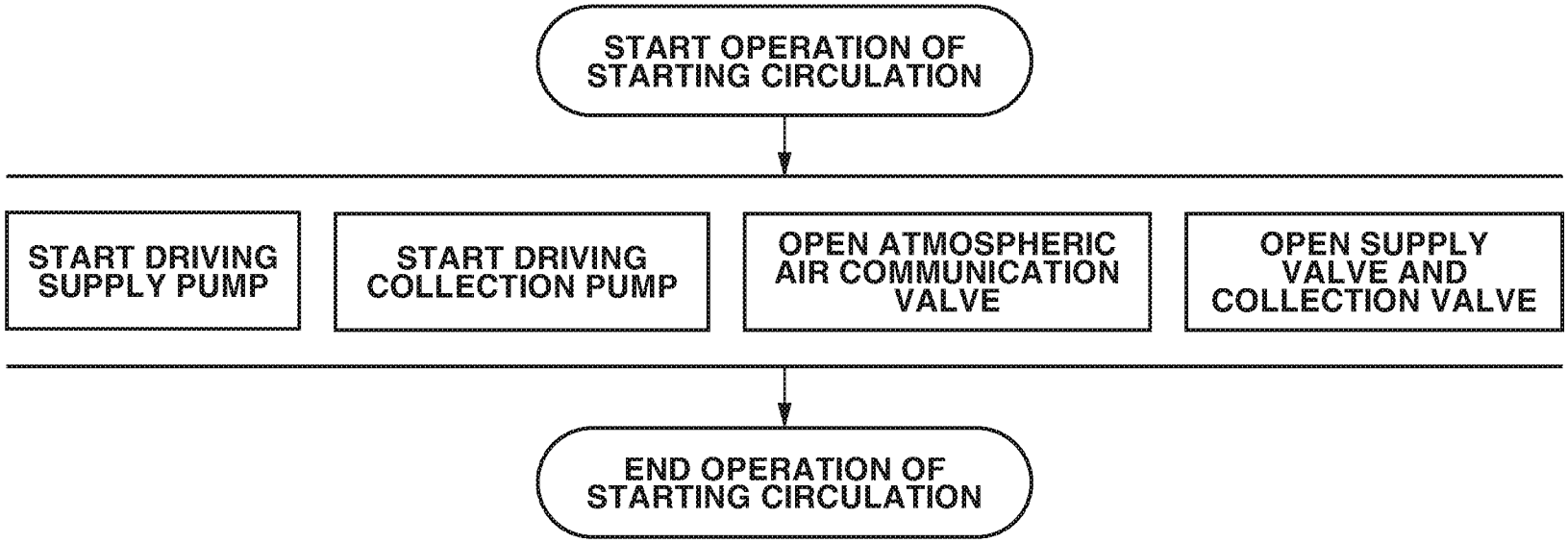
FIG. 15 is a flowchart illustrating control for changing the inkjet recording apparatus from the pause state to the recording state.

FIG. 15 illustrates a sequence of changing the recording apparatus 1 from the pause state to the recording state. The ink supply control unit 209 drives the supply pump P1 and the collection pump P2 and opens the atmospheric air communication valve V0. Furthermore, the ink supply control unit 209 opens the supply valve V2 and the collection valve V4. In the case in which the recording apparatus 1 is changed from the pause state to the recording state, it takes time for a pressure difference to occur between the first negative pressure control unit 81 and the second negative pressure control unit 82, so that the head unit 8 starts a recording operation about 20 seconds after the start of the circulation.

As described above, if a recording operation is ended, the recording apparatus 1 is first changed from the recording state to the waiting state which is a provisional pause state. This reduces the time needed to start the next recording operation so that the throughput of the recording operation improves. Further, in the case in which the recording apparatus 1 has been left in the waiting state for a long time, the recording apparatus 1 is changed to the pause state after the pressure in the channel is adjusted and the volume of the buffer chamber 85 is changed. This prevents air from being drawn and the ink from leaking through the discharge openings 2311. As described above, the recording apparatus 1 is provided which includes the waiting state where the head unit 8 is capped with the cap unit 10 as illustrated in FIG. 1 and the pause state. The recording apparatus 1 can reduce FPOT while adjusting the pressure in the channel by changing between the waiting state and the pause state based on a certain condition such as an elapsed time.

A second example embodiment will be described below. In the second example embodiment, a method of controlling the driving amount of the collection pump P2 at the time of changing from the waiting state or the pause state to the recording state, in addition to the control in the first example embodiment, will be described below. Specifically, when a circulation of the ink is started to change to the recording state, the driving amount of the collection pump P2 is set greater than that in the recording state. The structure of the recording apparatus 1 is similar to that in the first example embodiment, so that description thereof is omitted.

Figure 16:
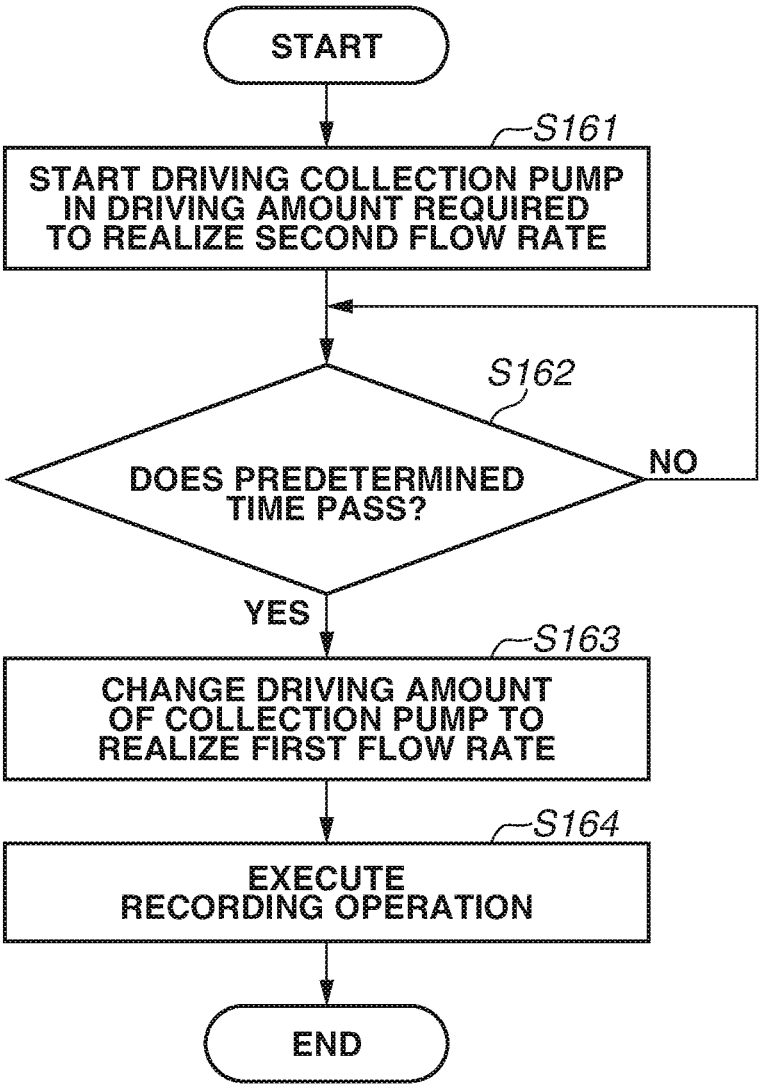
FIG. 16 is a flowchart illustrating control of a collection pump in changing the inkjet recording apparatus to the recording state.

FIG. 16 is a flowchart illustrating the control of the collection pump P2 at the time of changing to the recording state. The control other than the control of the collection pump P2 at the time of changing to the recording state is similar to those in FIGS. 13 and 15.

In step S161, the ink supply control unit 209 starts driving the collection pump P2 in a driving amount required to realize a second flow rate which is higher than a normal flow rate (first flow rate) of ink circulation. In step S162, the recording apparatus 1 waits until the predetermined time elapses. If the predetermined time elapses (YES in step S162), the processing proceeds to step S163.

In step S163, the ink supply control unit 209 changes the driving amount of the collection pump P2 to realize the first flow rate. In step S164, the print controller 202 controls the head carriage control unit 208 to execute a recording operation.

As described above, in the present example embodiment, the control is performed for the predetermined time at the time of the start of ink circulation such that the flow rate of the collection pump P2 is higher than that in normal ink circulation. This enables a larger negative pressure than a normal negative pressure to be applied to the negative pressure control unit, so that the time taken to generate a pressure difference between the first negative pressure control unit 81 and the second negative pressure control unit 82 can be reduced, thereby further reducing the FPOT. The control is effective especially in the case where the recording apparatus 1 is changed from the pause state to the recording state.

Specifically, the disclosure provides an inkjet recording apparatus capable of improving the throughput until a start of a recording operation in the structure in which ink is circulated between a recording head and an ink tank.

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2017-133836, filed Jul. 7, 2017, which is hereby incorporated by reference herein in its entirety.

What is claimed is:

1. An inkjet recording apparatus comprises:

a recording head which discharges an ink to perform a recording operation;

an ink tank which stores the ink to be supplied to the recording head;

a supply channel through which the ink is supplied from the ink tank to the recording head;

a supply pump provided in the supply channel;

a collection channel through which the ink is collected from the recording head to the ink tank;

a collection pump provided in the collection channel; and a buffer chamber provided in the recording head or the collection channel and having a volume which is changed according to a pressure, wherein the recording head includes a discharge opening through which the ink is discharged, a common channel connected with the supply channel and the collection channel, and a pressure control unit which changes, according to a pressure, between an opened state in which the ink is passed through the common channel and a closed state in which the ink is not passed through the common channel, wherein the inkjet recording apparatus forms a circulation state in which the ink is circulated between the recording head and the ink tank by driving the supply pump and the collection pump, whereas the inkjet recording apparatus stops the driving of the supply pump and the collection pump and forms a pause state in which the ink is not circulated, and wherein before the inkjet recording apparatus is to be changed from the circulation state to the pause state, the inkjet recording apparatus stops the driving of the supply pump and the collection pump and forms a waiting state for a predetermined time in which the negative pressure in the collection channel is larger than that in the pause state by the buffer chamber.

2. The inkjet recording apparatus according to claim 1, wherein the pressure control unit is in the opened state when the inkjet recording apparatus is in the waiting state.

3. The inkjet recording apparatus according to claim 1, wherein the recording head further includes a pressure chamber which is in communication with the discharge opening and is filled with the ink, a common supply channel which is connected with the supply channel and through which the ink is supplied to the pressure chamber, a common collection channel which is connected with the supply channel and the collection channel and through which the ink is collected from the pressure chamber, a first pressure control unit which is provided between the supply channel and the common supply channel and controls the pressure, and a second pressure control unit which is provided between the supply channel and the common collection channel and controls the pressure, wherein the second pressure control unit is changed from the closed state to the opened state by a larger negative pressure than the first pressure control unit so that the ink flows from the common supply channel through the pressure chamber into the common collection channel.

4. The inkjet recording apparatus according to claim 3, wherein the recording head further includes, in the discharge opening, a separate supply channel connected with the common supply channel and a separate collection channel connected with the common collection channel, and the ink is supplied to the pressure chamber through the common supply channel and the separate supply channel, and the ink is collected from the separate collection channel to the common collection channel.

5. The inkjet recording apparatus according to claim 1, wherein when the inkjet recording apparatus is changed from the waiting state to the pause state, the supply pump is driven to change the volume of the buffer chamber.

6. The inkjet recording apparatus according to claim 1, further comprising an atmospheric air communication valve which changes communication and non-communication between the ink tank and an atmospheric air, wherein when the inkjet recording apparatus is changed from the circulation state to the waiting state, the atmospheric air communication valve is closed.

7. The inkjet recording apparatus according to claim 6, wherein when the inkjet recording apparatus is changed from the waiting state to the circulation state, the supply pump and the collection pump are driven to open the atmospheric air communication valve.

8. The inkjet recording apparatus according to claim 1, wherein the collection pump is driven at a first flow rate in the circulation state, and wherein when the inkjet recording apparatus is changed from the waiting state to the circulation state, the collection pump is driven at a second flow rate higher than the first flow rate until the predetermined time passes.

9. The inkjet recording apparatus according to claim 1, wherein the ink tank includes an ink chamber which stores the ink and an air chamber which does not store the ink, and wherein a first channel having one end connected between the recording head and the supply pump and another end connected with the air chamber of the ink tank and a first valve provided in the first channel are included.

10. The inkjet recording apparatus according to claim 7, wherein when the inkjet recording apparatus is changed from the waiting state to the pause state, the atmospheric air communication valve is opened and the supply pump is driven, and thereafter the first valve is opened to adjust a pressure in the supply channel to an atmospheric pressure and then the first valve is closed.

11. The inkjet recording apparatus according to claim 1, further comprising:

a supply valve capable of opening and closing the supply channel and a collection valve capable of opening and closing the collection channel, wherein when the inkjet recording apparatus is changed from the waiting state to the pause state, the supply valve and the collection valve are closed.

12. The inkjet recording apparatus according to claim 11, wherein when the inkjet recording apparatus is changed from the pause state to the circulation state, the supply pump and the collection pump are driven to open the supply valve and the collection valve.

13. The inkjet recording apparatus according to claim 12, wherein the collection pump is driven at a first flow rate in the circulation state, and wherein when the inkjet recording apparatus is changed from the pause state to the circulation state, the collection pump is driven at a second flow rate higher than the first flow rate until the predetermined time passes.

14. A method of controlling an inkjet recording apparatus including a recording head which discharges an ink to perform a recording operation, an ink tank which stores the ink to be supplied to the recording head, a supply channel through which the ink is supplied from the ink tank to the recording head, a supply pump provided in the supply channel, a collection channel through which the ink is collected from the recording head to the ink tank, a collection pump provided in the collection channel, and a buffer chamber provided in the recording head or the collection channel and having a volume which is changed according to a pressure, the method comprising:

forming a circulation state in which the ink is circulated between the recording head and the ink tank by driving the supply pump and the collection pump and the recording head performs a recording operation;

stopping the driving of the supply pump and the collection pump and forming a waiting state in which the circulation of the ink is stopped, after the circulation state is formed; and forming a pause state in which a negative pressure in the collection channel is smaller than a negative pressure in the waiting state.

* * * * *